US008500114B2

(12) United States Patent
Matsumoto et al.

(10) Patent No.: US 8,500,114 B2
(45) Date of Patent: Aug. 6, 2013

(54) SHEET FEEDING APPARATUS AND IMAGE FORMING APPARATUS

(75) Inventors: Yuzo Matsumoto, Abiko (JP); Tetsuro Fukusaka, Abiko (JP); Yoshitaka Yamazaki, Abiko (JP); Taishi Tomii, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/544,085

(22) Filed: Jul. 9, 2012

(65) Prior Publication Data

US 2013/0026696 A1 Jan. 31, 2013

(30) Foreign Application Priority Data

Jul. 28, 2011 (JP) ..... 2011-165267

(51) Int. Cl.
*B65H 3/08* (2006.01)

(52) U.S. Cl.
USPC ..... 271/97; 271/98; 271/96; 271/108

(58) Field of Classification Search
USPC ..... 271/90, 94, 98, 97, 108
See application file for complete search history.

(56) References Cited

U.S. PATENT DOCUMENTS 5,478,066 A * 12/1995 Yoshida et al. ..... 271/12
5,645,274 A * 7/1997 Ubayashi et al. ..... 271/94
5,707,056 A * 1/1998 Rauen et al. ..... 271/96
6,082,728 A * 7/2000 Ubayashi ..... 271/108
7,007,942 B1 * 3/2006 Stearns et al. ..... 271/11
7,461,839 B2 * 12/2008 Ikeda ..... 271/108
7,568,691 B2 8/2009 Matsumoto
7,575,231 B2 8/2009 Sasaki et al.
7,591,459 B2 9/2009 Matsumoto et al.
7,823,875 B2 11/2010 Fukatsu et al.
8,132,806 B2 * 3/2012 Fuda ..... 271/98
8,167,296 B2 5/2012 Matsumoto
8,172,219 B2 * 5/2012 Matsumoto ..... 271/93
8,210,519 B2 * 7/2012 Fukusaka et al. ..... 271/98
8,262,080 B2 * 9/2012 Matsumoto et al. ..... 271/98
8,272,634 B2 9/2012 Fukatsu et al.
8,328,181 B2 * 12/2012 Kannari et al. ..... 271/94
2005/0206068 A1 9/2005 Sasaki et al.
2009/0001646 A1 1/2009 Matsumoto
2009/0267288 A1 10/2009 Sasaki et al.
2012/0049437 A1 * 3/2012 Matsumoto et al. ..... 271/11

* cited by examiner

*Primary Examiner* — Kaitlin Joerger
(74) *Attorney, Agent, or Firm* — Fitzpatrick, Cella, Harper & Scinto

(57) ABSTRACT

A sheet feeding apparatus and an image forming apparatus are provided. When sheets are adsorbed to an adsorption conveyance belt, a suction shutter is switched from a block position to block a negative pressure to an adsorption position to adsorb the sheets by the negative pressure. When the sheets conveyed in an overlapping manner reaches a predetermined number and the next sheet is adsorbed, the timing to switch the suction shutter to the adsorption position is delayed compared to the timing at which a preceding sheet adsorbed in advance and a subsequent sheet overlap.

13 Claims, 16 Drawing Sheets

FIG. 6

| NAME | BASIS WEIGHT [g/m²] | ADSORPTION TIME [msec] | CONVEYANCE SPEED [mm/sec] | CONVEYANCE DISTANCE OF PRECEDING SHEET BEFORE ADSORPTION [mm] |
|---|---|---|---|---|
| ULTRA-THIN PAPER | EQUAL TO OR LESS THAN 40 | 20 | 360 | 7.2 |
| THIN PAPER | 41～52 | 40 | 360 | 14.4 |
| PLAIN PAPER | 53～160 | 60 | 360 | 21.6 |
| HEAVY PAPER | 161～249 | 80 | 360 | 28.8 |
| ULTRA-HEAVY PAPER | EQUAL TO OR GREATERTHAN 250 | 100 | 360 | 36 |

*FIG. 9A*

| NAME | BASIS WEIGHT [g/m$^2$] | DISTANCE INTERVAL M[mm] |
|---|---|---|
| ULTRA-THIN PAPER | EQUAL TO OR LESS THAN 40 | 20 |
| THIN PAPER | 41～52 | 40 |
| PLAIN PAPER | 53～160 | 60 |
| HEAVY PAPER | 161～249 | 80 |
| ULTRA-HEAVY PAPER | EQUAL TO OR GREATERTHAN 250 | 100 |

*FIG. 9B*

| NAME | BASIS WEIGHT [g/m$^2$] | OVERLAP AMOUNT L L [mm] |
|---|---|---|
| ULTRA-THIN PAPER | EQUAL TO OR LESS THAN 40 | 10 |
| THIN PAPER | 41～52 | 20 |
| PLAIN PAPER | 53～160 | 30 |
| HEAVY PAPER | 161～249 | 40 |
| ULTRA-HEAVY PAPER | EQUAL TO OR GREATERTHAN 250 | 50 |

SHEET FEEDING APPARATUS AND IMAGE FORMING APPARATUS

BACKGROUND OF THE INVENTION

1. Field of the Invention

The present invention relates to a sheet feeding apparatus and image forming apparatus. Specifically, the present invention relates to a sheet feeding apparatus and image forming apparatus configured to separately feed sheets by blowing air to the sheets.

2. Description of the Related Art

In the related art, an image forming apparatus such as a printer, a copying machine has a sheet feeding apparatus that feeds, one by one, sheets carried on a tray holding a plurality of sheets. As such a sheet feeding apparatus, there is a sheet feeding apparatus of an air feeding system to blow up a plurality of sheets by blowing air to an end portion of a sheet bundle held by a tray, adsorb the sheets to an adsorption feeding belt arranged upward and feed the sheets one by one (see U.S. Patent Application Publication No. 2005/0206068 A1 and U.S. Patent Application Publication No. 2009/0267288 A1).

This air-feeding-system sheet feeding apparatus loosens sheets by blowing air to a leading-end-side edge portion of a sheet bundle on a tray and blowing up the sheets, and adsorbs the topmost sheet of the blown sheets to an adsorption conveyance belt by negative pressure. Further, by rotating the adsorption conveyance belt to which the sheet is adsorbed, it is possible to feed sheets one by one to the downstream side. By this means, the sheets are separately fed one by one to an image forming portion. This air-feeding-system sheet feeding apparatus has a higher resistance than a sheet feeding apparatus of a general friction separation system. Therefore, this air-feeding-system sheet feeding apparatus is often used in a field of simple bookbinding (e.g. light printing of a booklet or catalogue) using an image forming apparatus of an electrophotographic system, called POD (Print On Demand).

In recent years, it is demanded by users to increase productivity (i.e. the number of formed images per unit time) in an image forming apparatus. Especially, in the above-noted field of POD, it is necessary to perform light printing in volume, and therefore a sheet feeding apparatus of increased productivity is demanded. Generally, to increase productivity, it is necessary to increase the number of fed sheets per unit time in a sheet feeding apparatus. Therefore, in an air-feeding-system sheet feeding apparatus in the related art, there is a sheet feeding apparatus that, after separating sheets one by one, overlaps part of the next sheets on the separated sheets and conveys these.

However, in such a sheet feeding apparatus, to increase the number of fed sheets, it is necessary to not only overlap and convey sheets but also speed up the feeding speed of sheets to be fed. Here, to speed up the sheet feeding, it is necessary to blow up sheets at higher speed and speed up the conveyance speed of an adsorption conveyance belt.

Here, to blow up sheets at higher speed, it is necessary to speed up (or increase) the wind speed (or air volume) of air to be blown. However, if the wind speed (or air volume) is speeded up (or increased), regarding thin (i.e. the basis weight is small) sheets, these sheets are blown up all at once and cannot be loosened reliably. By this means, there arises a problem that a plurality of sheets is adsorbed to an adsorption conveyance belt and multi-fed.

Also, if the conveyance speed of an adsorption conveyance belt is excessively speeded up, regarding thick (i.e. the basis weight is large) sheets, there is a case where the sheets are fed without being reliably adsorbed to the belt due to fictitious force. That is, when sheets are sequentially fed and a position of the topmost sheet becomes low, there is a case where sheet adsorption starts by the time the position of the topmost sheet rises to a height at which adsorption is reliably performed. In this case, a sheet feeding delay is caused and a sheet jam may be caused. Thus, depending on a sheet basis weight, when sheets are fed in an overlapping manner, the overlapped parts may vary and a sheet multi-feed or jam may be caused.

The present invention is made in view of the above problems and has an object of providing a sheet feeding apparatus and image forming apparatus that can reduce the variability of overlapped parts when feeding sheets in an overlapping manner.

SUMMARY OF THE INVENTION

According to the present invention, there is provided a sheet feeding apparatus including a tray that can lift and lower and that holds a sheet, an air blowing portion that blows up a sheet by blowing an air to a side end of the sheet held by the tray and an adsorption conveyance system that adsorbs and conveys the blown up sheet. The adsorption conveyance system includes: an adsorption conveying portion that adsorbs and conveys the sheet blown up by blowing the air; a negative pressure generation portion that generates a negative pressure to adsorb the sheet to the adsorption conveying portion; an adsorption switching portion that is switchable between an adsorption position to adsorb a sheet by the negative pressure generated by the negative pressure generation portion and a block position to block the negative pressure; and a controller that controls the adsorption switching portion from the block position to the adsorption position such that a preceding sheet adsorbed in advance to the adsorption conveying portion is conveyed while partially overlapping a subsequent sheet, and in a case where a number of sheets conveyed in an overlapping manner reaches a predetermined sheet number and a next sheet is adsorbed, the controller changes a timing of switching the adsorption switching portion to the adsorption portion, from a first timing at which the subsequent sheet overlaps the preceding sheet to a second timing later than the first timing, and returns the timing to the first timing after the next sheet is adsorbed.

According to an aspect of the present invention, when the number of sheets conveyed in an overlapping manner reaches a predetermined number and the next sheet is adsorbed, by delaying the timing to switch an adsorption switching portion to an adsorption position, it is possible to reduce the variability of overlapped portions when feeding sheets in an overlapping manner.

Further features of the present invention will become apparent from the following description of exemplary embodiments with reference to the attached drawings.

BRIEF DESCRIPTION OF THE DRAWINGS

FIG. 6 is a table illustrating adsorption time, conveyance speed and conveyance distance of a preceding sheet before adsorption, for each basis weight of sheets of the above sheet feeding apparatus;

FIGS. 9A and 9B are tables setting a sheet bundle interval per sheet basis weight and the sheet overlap amount per basis weight;

DESCRIPTION OF THE EMBODIMENTS

Figure 1:
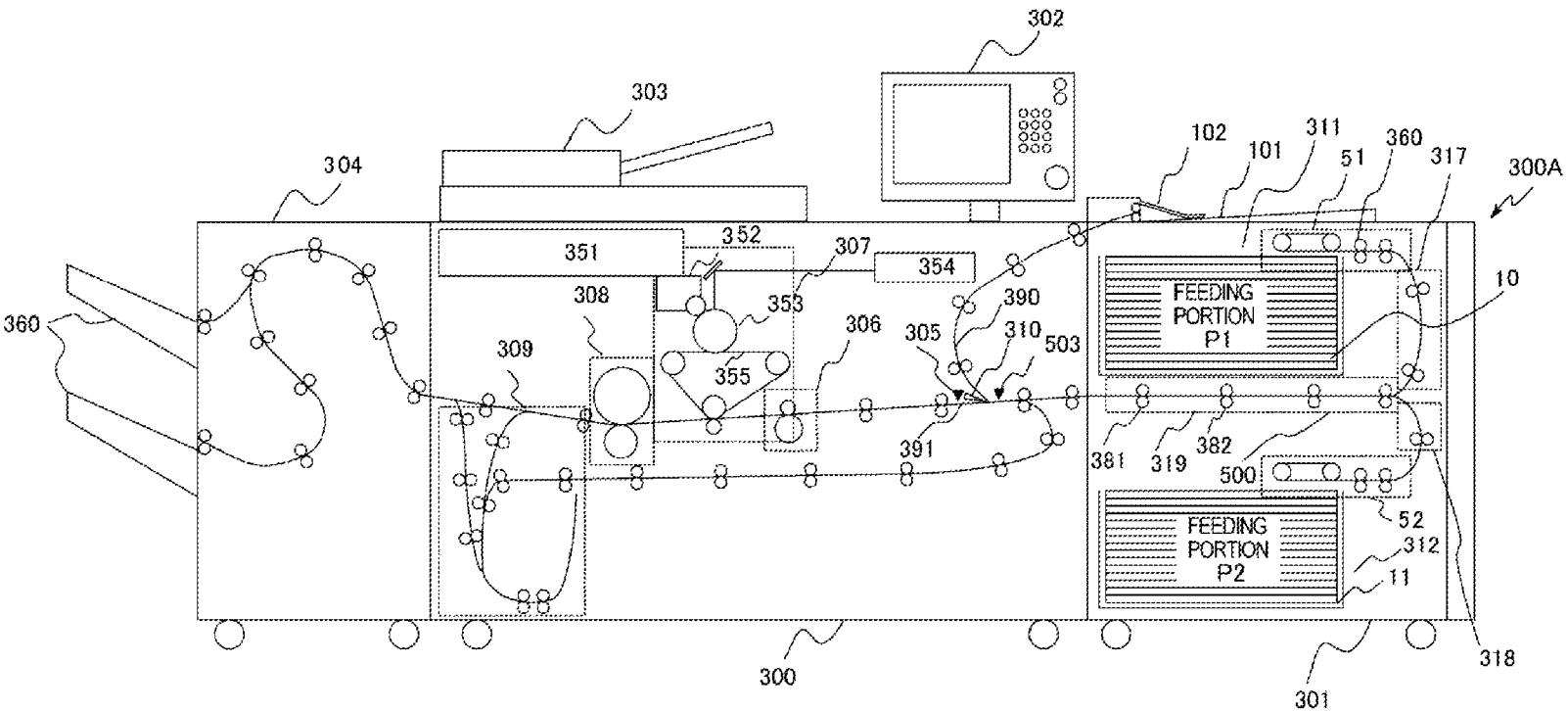
FIG. 1 is a schematic configuration diagram of an image forming apparatus having a sheet feeding apparatus according to a first embodiment of the present invention.

In the following, embodiments of the present invention will be described in detail using figures. FIG. 1 is a schematic configuration of an image forming apparatus having a sheet feeding apparatus according to a first embodiment of the present invention. In FIG. 1, an image forming apparatus 300A includes an image forming apparatus body (hereinafter referred to as "apparatus body") 300, a sheet feeding unit 301 and a sheet processing apparatus 304. Processing such as sheet feeding conveyance, image forming and stapling is implemented by a user based on sheet processing setting set by an operation portion 302 or an external host PC (not illustrated) and image information sent from a reader portion 303 or the external host PC.

The sheet feeding unit 301 has upper and lower sheet feeding apparatuses 311 and 312. These sheet feeding apparatuses 311 and 312 are provided with sheet storage cases 10 and 11 that store a sheet bundle, and adsorption conveying units 51 and 52 that feed sheets stored in the sheet storage cases 10 and 11. Here, in the present embodiment, the adsorption conveying units 51 and 52 adopt an air feeding system, and adsorb a sheet to an endless belt and feed the sheet at the time of a sheet feeding operation.

Here, according to sheet request information from the apparatus body 300, the sheet feeding unit 301 sequentially feeds and conveys sheets of the sheet storage cases 10 and 11 and, after completing the processing, reports the completion of preparation to the apparatus body 300. The apparatus body 300 receives the report of completion of ready from the sheet feeding unit 301, and reports a transfer request. The sheet feeding unit 301 separately feeds sheets one by one to the apparatus body 300 in order every transfer request report, and, after feeding sheets of the requested number, finishes the operation and turns to a standby state.

Here, a sheet conveyed by an adsorption conveying unit 51 of the upper sheet feeding apparatus 311 is fed to the apparatus body 300 via an upper conveying portion 317 and an interflow conveying portion 319. Also, a sheet conveyed by an adsorption conveying unit 52 of the lower sheet feeding apparatus 312 is fed to the apparatus body 300 via a lower conveying portion 318 and the interflow conveying portion 319. Here, each of conveying portions 317 to 319 has a stepping motor for conveyance (not illustrated), and, by controlling the motor by a conveyance controller and rotating the conveying roller of each portion, a sheet is fed.

Also, an upper surface of the sheet feeding unit 301 is provided with an escape tray 101 that forcefully ejects an abnormal sheet due to overlap feeding or jam. There is provided a full-loaded detection sensor 102 set to detect a full loaded condition of an ejection sheet to the escape tray 101. Also, on each conveyance path of the sheet feeding unit 301, a plurality of conveyance sensors (not illustrated) is set to detect that a sheet passes through each conveyance path.

The apparatus body 300 is set to form an image on a sheet fed by the sheet feeding unit 301, the operation portion 302 to perform operation setting by the user is disposed on the upper surface and the reader portion 303 to read an image of an original is arranged on the upper portion. Also, this apparatus body 300 includes an image creation portion 307 including a photosensitive drum 353, a laser scanner unit 354, a development portion 352 and an intermediate transfer belt 355, a fixing portion 308 and a reverse conveying portion 309.

After receiving a sheet from the sheet feeding unit 301, the apparatus body 300 performs sheet conveyance by controlling each conveying portion set in a conveyance path 391 that is a first conveyance path to guide the sheet to the image creation portion 307. Next, starting from sheet detection in an image reference sensor 305, an image forming operation based on image data received in the image creation portion 307 is performed. Also, when a jam sensor 503 detects an abnormal sheet, a switching member 310 is switched to guide the sheet to an escape path 390, which is a second conveyance path before the image creation portion 307, and eject the sheet to the escape tray 101 that is an ejection portion.

Here, at the time of the image forming operation, when the image reference sensor 305 detects a sheet, a semiconductor laser (not illustrated) forming the laser scanner unit 354 is lighted, light quantity control is implemented and a scanner motor that performs rotational control of a polygon mirror (not illustrated) is controlled. By this means, laser light based on image data is irradiated to the photosensitive drum 353 to form a latent image on the photosensitive drum 353.

Next, in the development portion 352, toner is fed from a toner bottle 351 such that the latent image on the photosensitive drum 353 is developed, and the developed toner image is primary-transferred to the intermediate transfer belt 355. After that, by secondary-transferring the toner image transferred on the intermediate transfer belt to a sheet, the toner image is formed on the sheet. Here, a registration controller 306 is provided immediately before the secondary transfer position. By this registration controller 306, correction of skew feeding of a sheet with respect to a sheet immediately before a transfer position and sheet conveyance control of fine-tuning and aligning the toner image formed on the intermediate transfer belt 355 and a sheet front edge position, are performed without stopping the sheets.

Next, the secondary-transferred sheet is conveyed to the fixing portion 308 and toner is heated and pressed in the fixing portion 308 and melted and fixed on the sheet. Also, the fixed sheet is conveyed to the reverse conveying portion 309 in the case of subsequently performing printing (i.e. image forming) on the reverse face or reversing the face of the sheet, or the fixed sheet is conveyed to the downstream sheet processing apparatus 304 in the case of completion of the printing. Also, the sheet processing apparatus 304 implements desired processing (such as folding, stapling and boring) set by the user in the operation portion 302, on the image-formed sheet ejected from the apparatus body 300, and sequentially outputs the sheet to an ejection tray 360 as a deliverable.

Figure 2:
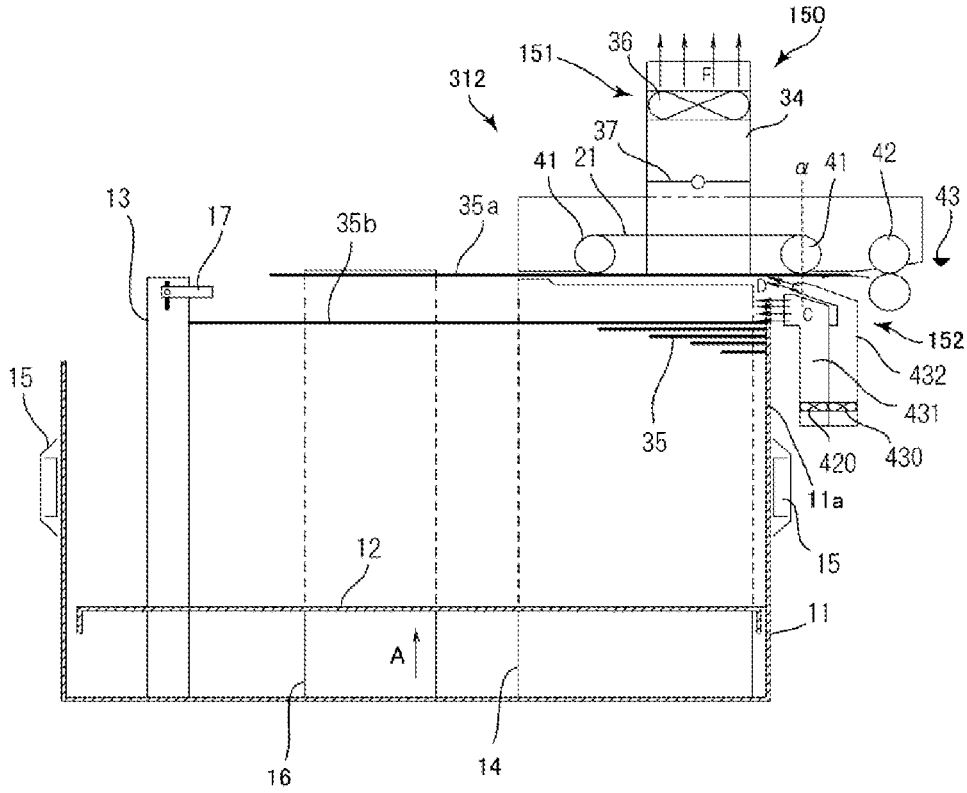
FIG. 2 is a diagram illustrating a configuration of a lower sheet feeding apparatus set in a sheet feeding unit of the above image forming apparatus.

FIG. 2 is a diagram illustrating a configuration of the lower sheet feeding apparatus 312 set in the sheet feeding unit 301. Here, the upper sheet feeding apparatus 311 employs the same configuration. The sheet storage case 11 has a tray 12 that can lift and lower on which a plurality of sheets 35 is placed, and a back-end control plate 13 corresponding to a back-end control member that contacts to the back end as an upstream side end of the sheets in the sheet feeding direction and that controls the back-end portion. Further, the sheet storage case 11 includes a front-end control plate 11*a* that controls the front end as a downstream side end of the sheets 35 in the sheet feeding direction, side-end control plates 14 and 16 that control a position in the width direction corresponding to a direction orthogonal to the sheet feeding direction of the sheets 35, and a slide rail 15.

On the upper portion of the back-end control plate 13, there is provided a sheet-back-end holding member 17 corresponding to a pressure member that holds the back-end portion of a topmost sheet 35*a* and separates sheets, so as to be slidable in the vertical direction and rotatable. Also, when the sheet-back-end holding member lifts above a predetermined position as the tray 12 lifts, a CPU (described later) determines based on a signal from a back-end paper plane detection sensor (not illustrated) that an upper surface (hereinafter referred to as "sheet surface") of the topmost sheet 35*a* is high, and the CPU controls to lower the tray 12.

This sheet storage case 11 can be drawn from the sheet feeding unit 301 by the slide rail 15 and, when the sheet storage case 11 is drawn, the tray 12 lowers to a predetermined position such that it is possible to replenish or exchange sheets. Further, above the upper portion of this sheet storage case 11, there is provided an air-feeding-system sheet feeding system (hereinafter referred to as "air feeding system") 150 to separate and feed sheets one by one. This air feeding system 150 has an adsorption conveying system 151 that adsorbs and conveys the sheets 35 placed on the tray 12, and an air blowing portion 152 that loosens the sheet bundle on the tray by blowing up the upper portion and separates the sheets 35 one by one.

The adsorption conveying system 151 has an adsorption conveyance belt 21 that is bridged to a belt driving roller 41 and forms an adsorption conveying portion to adsorb and feed the sheets 35 in the right direction of the figure, and a suction fan 36 that generates a negative pressure to adsorb the sheets 35 to the adsorption conveyance belt 21. Further, there is provided a suction duct 34 that is arranged inside the adsorption conveyance belt 21 and sucks air via a suction hole (not illustrated) formed in the adsorption conveyance belt 21. Further, there is provided with a suction shutter 37 arranged in the suction duct 34 to turn on/off an adsorption operation of the adsorption conveyance belt 21.

Also, the air blowing portion 152 includes a loosening fan 420 and a loosening duct 431 having a nozzle to blow exhaust air of the loosening fan 420 as air to the sheet front-end portion, and has a loosening portion that blows loosening air in the direction of arrow C (i.e. approximately horizontal direction) in the figure. Also, the air blowing portion 152 includes a separation fan 430 and a separation duct 432 having a nozzle to blow exhaust air of the separation fan 430 as separation air to the sheet front-end portion, and has a separation portion that blows separation air in the direction of arrow D in the figure.

The air sucked by the loosening fan 420 is blown from the loosening duct 431 toward the direction of arrow C to blow up a few numbers of upper sheets of the sheets 35 placed on the tray 12. Also, the air sucked by the separation fan 430 is blown from the separation duct 432 toward the direction of arrow D to separate the topmost sheet 35*a* blown up by the loosening portion from other sheets and adsorb the sheet to the adsorption conveyance belt 21. The sheet 35*a* adsorbed to the adsorption conveyance belt 21 in this way is fed to a pull-out roller pair 42 in the conveyance direction downstream by the adsorption conveyance belt 21.

Figure 3A:
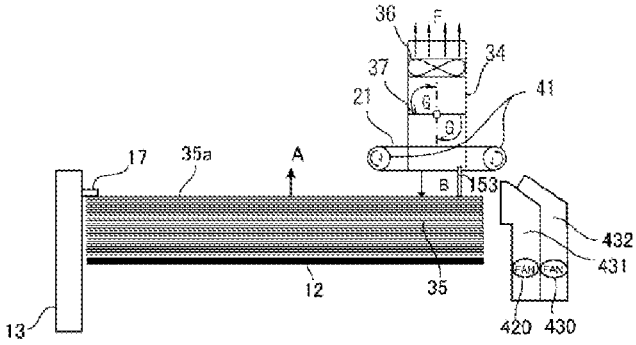
FIGS. 3A to 3D are diagrams to describe a sheet adsorption conveyance operation of an adsorption conveying unit set in the above sheet feeding apparatus.

Next, a sheet feeding operation of the sheet feeding unit 301 (i.e. the air feeding system 150) configured as above will be described. First, the user draws the sheet storage case 11 to set the sheets 35, and, when the sheet storage case 11 is stored, the tray 12 lifts in the direction of arrow A as illustrated in FIG. 3A. After that, when it reaches a feeding-enabled position at which the distance to the adsorption conveyance belt 21 is "B," a CPU (described later) stops the tray 12 at this position and is prepared for a sheet feeding signal to start feeding.

Figure 3B:
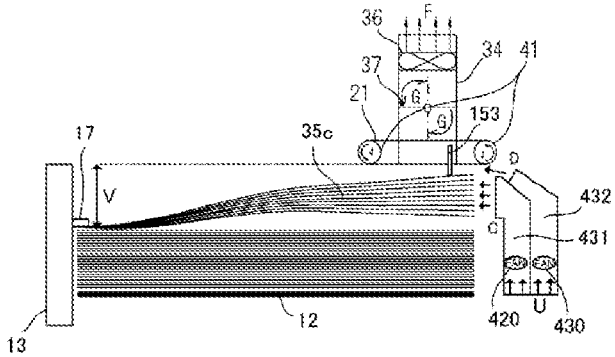

Next, when the sheet feeding signal is detected, the loosening fan 420 and the separation fan 430 are operated and air is sucked from the direction of arrow U to the loosening duct 431 and the separation duct 432 as illustrated in FIG. 3B. This air is blown from the directions of arrows C and D to the sheet bundle by the nozzles of the loosening duct 431 and the separation duct 432, respectively. By this means, a few numbers of upper sheets 35*c* of the sheet bundle are blown up.

Also, the CPU operates the suction fan 36 as a negative pressure generation portion and expels air in the F direction in the figure. At this time, the suction shutter 37, which is an adsorption switching portion that is switchable between an adsorption position to adsorb a sheet by negative pressure generated by the suction fan 36 and a block position to block the negative pressure, is still closed. Therefore, the topmost sheet 35*a* is not adsorbed to the adsorption conveyance belt 21. Also, in this case, the CPU detects a paper plane of the topmost sheet 35*a* by a back-end paper plane detection sensor (not illustrated) to detect a position of the sheet back-end holding member 17 and a paper plane detection sensor 153 corresponding to a paper plane detection portion. The CPU controls a position of the tray 12 such that the distance between the sheet back-end holding member 17 and the adsorption conveyance belt 21 in the vertical direction is V.

Figure 3C:
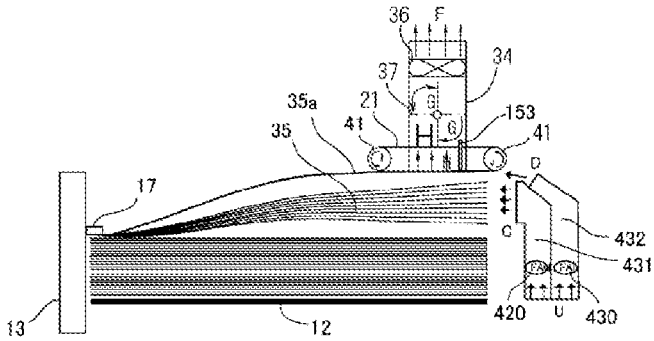

Next, when predetermined time passes after detection of the sheet feeding signal and the a few number of upper sheets 35*c* are stably blown up, the CPU drives an adsorption solenoid (described later) to rotate the suction shutter 37 in the direction of arrow G illustrated in FIG. 3B and move to the adsorption position. By this means, as illustrated in FIG. 3C, air is sucked from a suction hole set in the adsorption conveyance belt 21 to the direction of arrow H to generate suction power. By this suction power and separation air, only the topmost sheet 35*a* is adsorbed to the adsorption conveyance belt 21.

Figure 3D:
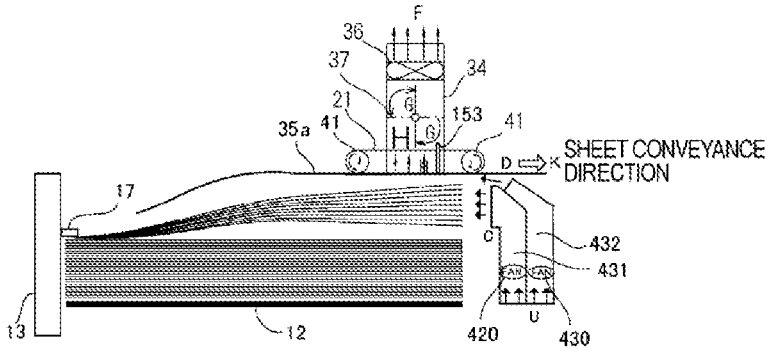

Next, the CPU drives a feeding motor (described later) to rotate the belt driving roller 41 in the direction of arrow J illustrated in FIG. 3D. By this means, the topmost sheet 35*a* is fed in the direction of arrow K while being adsorbed to the adsorption conveyance belt 21, and, after that, the topmost sheet 35*a* is conveyed to the apparatus body 300 by the pull-out roller pair 42 illustrated in FIG. 2 via the lower conveying portion 318 and the interflow conveying portion 319. Here, in the downstream of this pull-out roller pair 42, a pull-out sensor 43 as a detection portion to detect a sheet conveyed by the pull-out roller pair 42 is set, and the CPU monitors by this pull-out sensor 43 that the sheet 35*a* passes.

Figure 4:
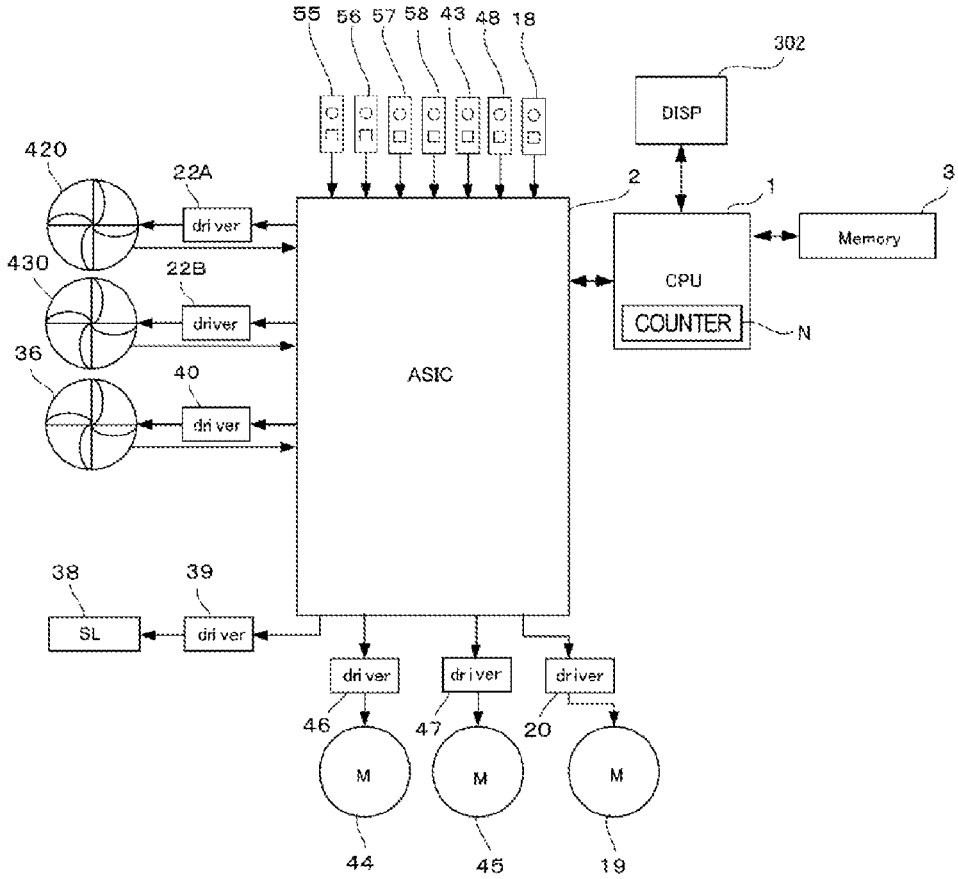
FIG. 4 is a control block diagram of the above sheet feeding unit.

FIG. 4 is a control block diagram of the sheet feeding unit 301 according to the present embodiment. In FIG. 4, a CPU 1 denotes a controller to control the sheet feeding unit 301 and, in the present embodiment, is disposed in the apparatus body 300. This CPU 1 is connected to a dedicated ASIC 2 to output a drive start instruction to a driver that drives various loads of the sheet feeding unit 301 such as a motor and a fan so as to drive the various loads.

Also, the CPU 1 is connected to an operation portion (DISP) 302 corresponding to a sheet information setting portion that can input sheet information such as a sheet size, sheet basis weight and sheet surface property, and a counter N is disposed inside. Further, the CPU 1 is connected to a storage unit (or memory) 3 that stores various kinds of data input in the operation portion 302 and a target value or PWM value used for fan adjustment.

The CPU 1 refers to data stored in the storage unit 3 and, according to the sheet information input by the user from the operation portion 302, adjusts the distance B between the adsorption conveyance belt 21 and the topmost sheet 35*a* in the sheet storage case 11. Here, instead of the operation portion 302, it may be possible to set a detection portion (not illustrated) that detects at least one of sheet size information, sheet basis weight information and sheet surface property information as sheet information, and input this sheet information from the detection portion as an input portion to the CPU 1.

As described below, according to sheets adsorbed to the adsorption conveyance belt 21, the ASIC 2 controls the timing at which a subsequent sheet is adsorbed, such that part of the subsequent sheet overlaps, by a predetermined overlap amount, with a preceding sheet adsorbed earlier. Also, this ASIC 2 is connected to a sheet storage portion open/close sensor 48 that detects an open/close state of the sheet storage case 11 (10), and a lower position detection sensor 55 and upper position detection sensor 57 that detect a position of the tray 12 in the sheet storage case 11 (10). Further, this ASIC 2 is connected to a paper plane detection sensor 18 that detects a sheet upper surface placed on the tray 12 and a paper existence/non-existence detection sensor 56 that detects an existence or non-existence of a sheet on the tray 12.

Also, the ASIC 2 is connected to an adsorption completion sensor 58 that monitors a negative pressure condition in a suction duct when sheets are adsorbed by the above pull-out sensor 43 and the suction fan 36, and that detects that the sheet adsorption is completed. Further, this ASIC 2 not only outputs a driving start instruction to a driver that drives each load of the sheet feeding unit 301 but also performs PWM control so as to rotate a fan by a target rotation number in response to a rotation number signal (FG) of the loosening fan 420, the separation fan 430 or the suction fan 36.

Also, in FIG. 4, a loosening fan driver 22A sends a PWM signal output from the ASIC 2 and supplies power to the separation fan 420. A loosening fan driver 22B sends a PWM signal output from the ASIC 2 and supplies power to the separation fan 430. A suction fan driver 40 sends a PWM signal output from the ASIC 2 and supplies power to the suction fan 36.

A driver 39 denotes a driver of a suction solenoid 38 that opens or closes the suction shutter 37 in the suction duct 34, and a driver 46 drives a feeding motor 44 to drive the belt driving roller 41. A driver 47 drives a pull-out motor 45 to drive the pull-out roller pair 42. These feeding motor 44 and pull-out motor 45 are pulse motors, a control pulse is given from the ASIC 2 to the drivers 39, 46 and 47, and, according to the pulse number, the motor rotation amount is controlled. A driver 20 drives a lifter motor 19 corresponding to lifter driving means that lifts and lowers the tray 12. This lifter motor 19 denotes a DC motor and is drive-controlled by ON/OFF operation.

Also, in the present embodiment, although each load of the sheet feeding apparatus such as a motor, a fan and a sensor is controlled by the CPU 1 via the dedicated ASIC 2, the CPU 1 may perform direct control. Also, in the present embodiment, there is provided the operation portion 302 as a setting portion that can input sheet information such as a sheet size, sheet basis weight and sheet surface property, and the CPU 1 is directly connected to the storage unit 3 that stores various kinds of data input in this operation portion 302 and a target value or PWM value used for fan adjustment. However, another apparatus in the image forming system having a sheet feeding apparatus, for example, the operation portion 302 having the image forming apparatus may be used as a storage unit to input and store sheet information.

Meanwhile, in the present embodiment, the CPU 1 as a controller performs overlap conveyance to adjust the timing to adsorb a subsequent sheet via the ASIC 2 and convey the subsequent sheet while partially overlapping a preceding sheet. As a result, in an apparatus in which a conveyance path from the sheet feeding unit 301 to the image creation portion 307 is relatively shorter, it is possible to ensure high productivity in a state where the feeding conveyance speed is reduced, and feed and convey a sheet with energy conservation and low operation sound.

Figure 5A:
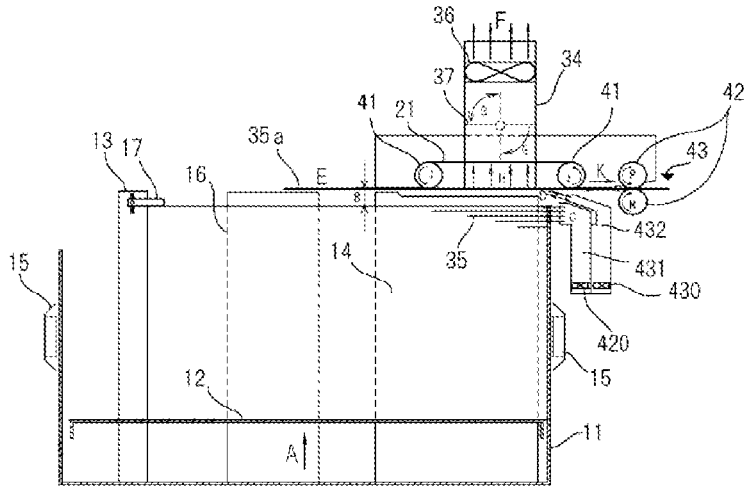
FIGS. 5A to 5C are diagrams to describe a sheet overlap conveyance operation of the above sheet feeding apparatus.

Next, such a sheet overlap conveyance operation will be described using FIGS. 5A to 5C. By the above-described adsorption conveyance operation by the adsorption conveyance belt 21, the preceding sheet (i.e. topmost sheet) 35*a* indicated by solid line is conveyed by a predetermined amount as illustrated in FIG. 5A, and, for example, when the front end reaches the pull-out roller pair 42, the suction shutter 37 is closed. Here, after the front end of the preceding sheet 35*a* reaches the pull-out roller pair 42 and advances a predetermined distance, the suction shutter 37 may be controlled to be closed.

Figure 5B:
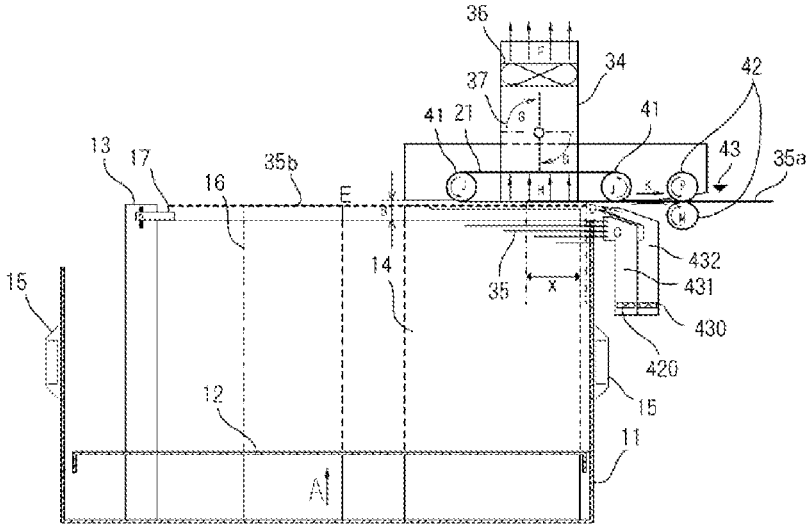
Figure 5C:
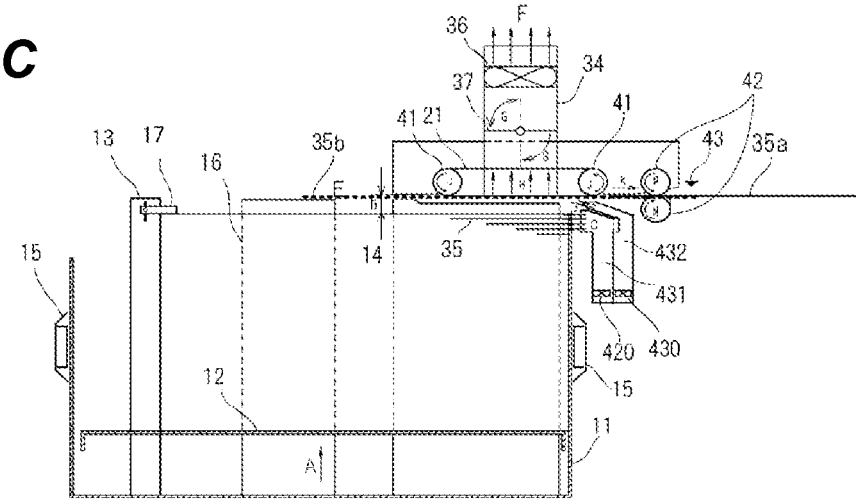

After that, at the timing the preceding sheet 35*a* reaches a predetermined position, the suction shutter 37 is rotated again in the direction of arrow G as illustrated in FIG. 5B. By this means, a next sheet (i.e. subsequent sheet) 35*b* to the topmost 35 as illustrated by dotted line is adsorbed by the adsorption conveyance belt 21 and conveyed in a tiled state in which the subsequent sheet 35*b* overlaps the preceding sheet 35*a*. Thus, in the present embodiment, while the preceding sheet 35*a* is conveyed, by closing the suction shutter 37 once and thereafter opening the suction shutter 37, the two sheets 35*a* and 35*b* are overlapped and conveyed in a tiled state.

By closing this suction shutter 37 and setting the opening timing, it is possible to convey the two sheets 35*a* and 35*b* using a predetermined value as an overlap amount X between sheets. That is, in the CPU 1 (ASIC 2), by controlling the driving timing of the suction shutter 37 such that the overlap amount between sheets is a predetermined value, it is possible to obtain the optimal overlap amount X. After that, the preceding sheet 35*a* and the subsequent sheet 35*b* are conveyed by the adsorption conveyance belt 21 in the K direction, in a tiled state in which the optimal overlap amount X is held as illustrated in FIG. 5C. After that, operations illustrated in FIGS. 5A to 5C are repeated until the job is finished.

Also, when sheets are sequentially fed, sine the height of the topmost sheet 35*a* gradually lowers and accordingly the time to adsorb sheets becomes longer, the overlap amount X may gradually shift (i.e. the value of X decreases) during sheet conveyance. Therefore, for example, by detecting the sheet thickness by the pull-out sensor 43, the sheet overlap amount (i.e. distance in the sheet conveyance direction of an overlap range) is detected. Based on the detection result of this pull-out sensor 43, the driving timing of the suction shutter 37 to adsorb the subsequent sheet may be controlled.

By this means, it is possible to stably feed sheets in a state where the optimal overlap amount X is maintained. Here, by controlling the driving timing of the suction shutter 37 based on sheet information (or setting information) set in the operation portion 302, it is possible to maintain the optimal overlap amount X between the preceding sheet 35*a* and the subsequent sheet 35*b*.

Meanwhile, depending on the sheet basis weight, adsorption time "t" required to adsorb a sheet, that is, time "t" lapsed after the suction solenoid 38 is turned on and before the adsorption completion sensor 58 is turned on, varies. Also, in the present embodiment, the adsorption conveyance belt 21 is always driven at constant speed V, and therefore the preceding sheet advances by V×t by the time the subsequent sheet 35*b* is adsorbed to the adsorption conveyance belt 21. Therefore, when the adsorption time "t" varies, the overlap amount X also varies. That is, to maintain the overlap amount X of two sheets without depending on basis weight, it is necessary to control (or adjust) the timing at which the suction shutter 37 is turned on, according to adsorption time based on the sheet basis weight.

Here, when the length of the sheets 35 in the sheet conveyance direction is L, the timing to turn on the suction shutter 37 is after the preceding sheet is adsorbed to the adsorption conveyance belt 21 and advances by L1 (=L−X−V×t). Here, it is assumed that the adsorption time "t" includes response time of the suction solenoid 38, response time of the suction shutter 37 and time required to adsorb the sheet 35*b* to the adsorption conveyance belt 21.

In the present embodiment, an adsorption time table for each sheet basis weight illustrated in FIG. 6 is stored in the storage unit 3. For example, adsorption time of an A4-size (i.e. sheet-conveyance-direction length=210 mm) sheet (plain paper) is 60 msec. Also, in the case of conveying this A4-size sheet (plain paper) with 50 mm overlap part at 360 mm/sec, the timing to turn on the suction shutter 37 is 138.4 mm from the following equation.

$$L1=210-50-360\times0.06=138.4\text{ mm}$$

That is, in a case of conveying a sheet in an overlapping manner at adsorption time of 60 msec, after the preceding sheet is adsorbed and conveyed by 138.4 mm, that is, when the distance between the back end of the preceding sheet and the front end of the subsequent sheet is (50+21.6) mm, the suction shutter 37 is turned on. Also, in the present embodiment, as illustrated in FIG. 5B, the timing to turn off the suction shutter 37 is after the front end of the next sheet (illustrated by dotted line) reaches the pull-out roller pair 42 and is conveyed by predetermined distance.

Also, based on consideration data, as illustrated in FIG. 6, adsorption time of ultra-thin papers is set to 20 msec and adsorption time of ultra-heavy paper is set to 100 msec. In this case, when it is assumed that an optimal overlap amount is 50 mm, in a case where the distance between the back end of the preceding sheet and the front end of the next sheet is (50+7.2) mm in the case of ultra-thin papers and (50+36) mm in the case of ultra-heavy papers, the suction shutter 37 is controlled to be turned on.

Also, in the present embodiment, the adsorption conveyance belt 21 is always driven to perform an adsorption conveyance operation of sheets only by turning on/off the suction shutter 37. However, it may be possible to perform ON/OFF control of the driving of the adsorption conveyance belt 21 and control the suction shutter 37 and the adsorption conveyance belt 21 independently to adsorb and convey sheets.

Meanwhile, as described above, when the height of the topmost sheet lowers as sheets are sequentially fed, the interval between the adsorption conveyance belt and the topmost sheet becomes wider. In this way, when the interval between the adsorption conveyance belt and the topmost sheet becomes wider, adsorption power of the adsorption conveyance belt with respect to the topmost sheet is gradually weakened, and, when a certain number of sheets is fed, it becomes difficult to perform adsorption in the adsorption conveyance belt. Therefore, to prevent this, it is controlled so as to detect the height of the topmost sheet in the sheet storage case 11 and, if the height of the topmost sheet is not a predetermined value, lift the tray 12 to the predetermined value.

However, since air is always blown to a sheet group near the topmost sheet, the paper plane position lifts and lowers, and therefore it is very difficult to detect the paper plane position accurately. Also, especially when the sheet conveyance speed is fast, when sheets in the sheet storage case 11 are sequentially fed and the height of the topmost sheet lowers, an adsorption operation is performed before the topmost sheet moves to an appropriate paper plane position. In this case, the interval between the topmost sheet collected in the sheet storage case 11 and the adsorption conveyance belt is widened. As a result, the adsorption time is increased, the length of overlapped parts is shorted, and therefore the length of overlapped parts varies.

Figure 7A:
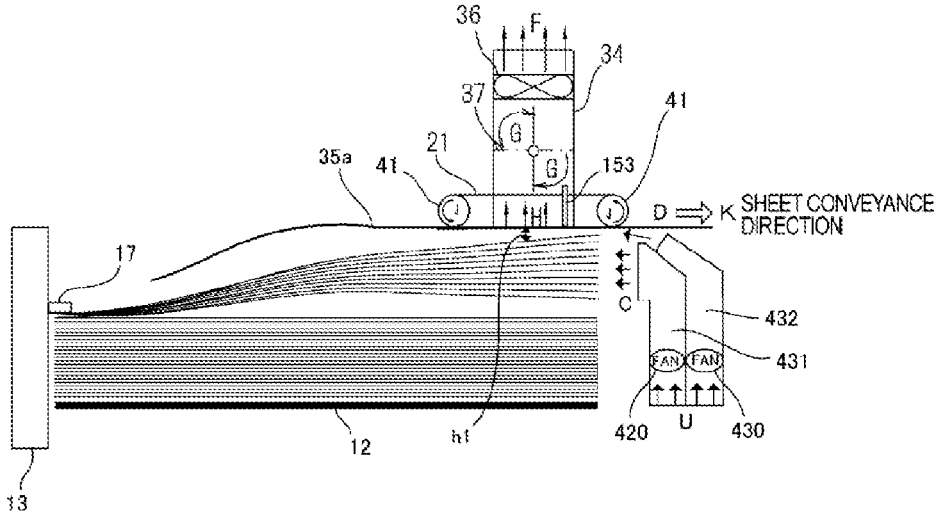
FIGS. 7A to 7C are diagrams to describe a state where, at the time of a sheet overlap conveyance operation in the above sheet feeding apparatus, a position of the topmost sheet lowers every time a sheet is fed.

This will be described below in detail using FIGS. 7A to 7C, 8A and 8B. FIG. 7A illustrates a state where the first topmost sheet 35*a* is conveyed while being adsorbed to the adsorption conveyance belt 21. Here, it is assumed that the adsorption conveyance belt 21 is always driven. When the front end of the first sheet 35*a* reaches the pull-out sensor 43, the suction shutter 37 is controlled to be closed. After that, when the first sheet 35*a* is conveyed by predetermined amount in the pull-out roller, the suction shutter 37 is opened such that the back end of the first sheet 35*a* and the front end of the second sheet 35*b* overlap by predetermined amount L1.

Figure 7B:
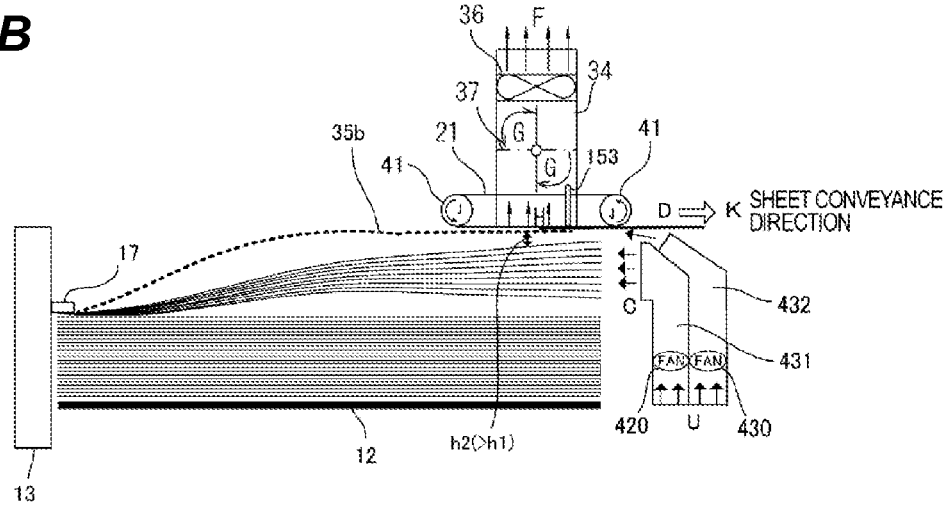
Figure 7C:
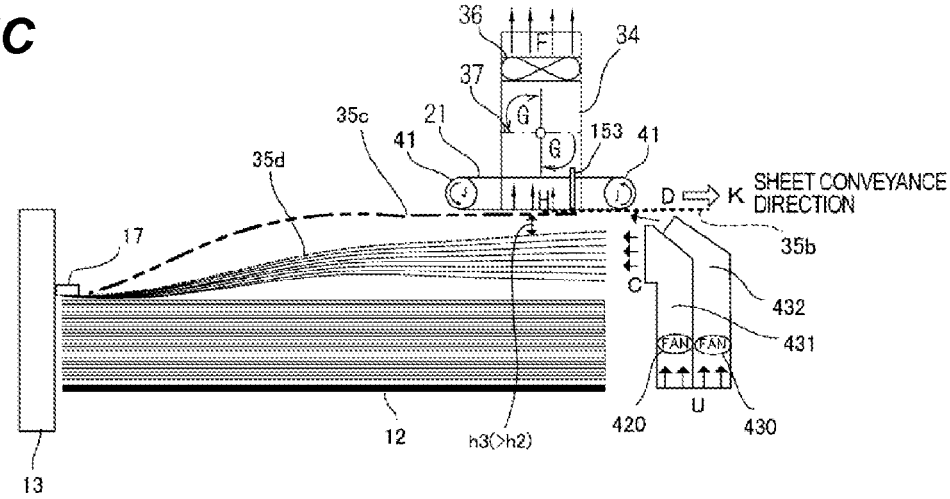
Figure 8A:
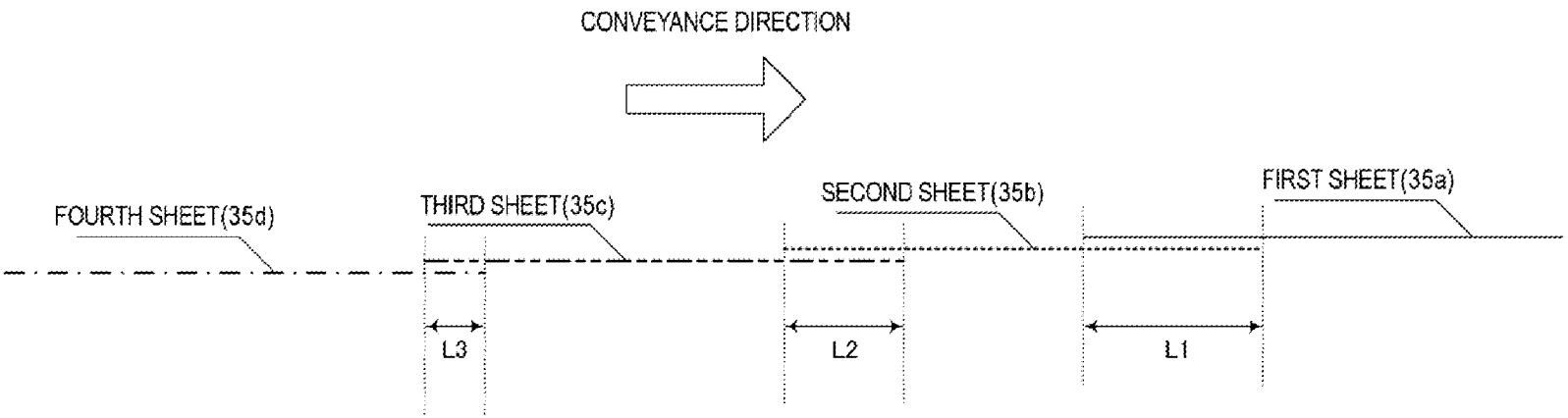
FIGS. 8A and 8B are diagrams to describe a state where, at the time of a sheet overlap conveyance operation in the above sheet feeding apparatus, the sheet overlap amount between sheets every time a sheet is fed.

By this means, as illustrated in FIGS. 7B and 8A, the first sheet 35*a* and the second sheet 35*b* are conveyed by the adsorption conveyance belt 21 in a state where these sheets overlap by the predetermined amount L1. Next, when the front end of the second sheet 35*b* reaches the pull-out sensor 43, the suction shutter 37 is closed. After that, when the second sheet 35*b* is conveyed by predetermined amount in the pull-out roller, as illustrated in FIG. 7C, the suction shutter 37 is opened such that the back end of the second sheet 35*b* and the front end of a third sheet 35*c* overlap by the predetermined amount L1.

However, at this time, the third sheet 35*c* cannot be sufficiently blown up, and the distance to the adsorption conveyance belt 21 is h2 (>h1). Therefore, the time from the suction shutter 37 is opened to the third sheet 35*c* is adsorbed to the adsorption conveyance belt 21, becomes longer compared to the case of the second sheet 35*b*. As a result, actually, as illustrated in FIG. 8A, the second sheet 35*b* and the third sheet 35*c* overlap by overlap amount L2 that is a smaller value than the predetermined amount L1. Further, when the front end of the third sheet 35*c* reaches the pull-out sensor 43, the suction shutter 37 is closed. After that, when the third sheet 35*c* is conveyed by predetermined amount in the pull-out roller, the suction shutter 37 is opened such that the back end of the third sheet 35*c* and the front end of a fourth sheet 35*d* overlap by the predetermined amount L1.

However, even in this case, the fourth sheet 35*d* cannot be sufficiently blown up, and the distance to the adsorption conveyance belt 21 is h3 (>h2). Therefore, the time from the suction shutter 37 is opened to the fourth sheet 35*d* is adsorbed to the adsorption conveyance belt 21, becomes longer compared to the case of the third sheet 35*c*. As a result, actually, as illustrated in FIG. 8A, the third sheet 35*c* and the fourth sheet 35*d* overlap by overlap amount L3 that is a smaller value than the predetermined amount L2. That is, when the preceding sheet is fed, especially in the case of a sheet of large basis weight, the subsequent sheet is adsorbed before the distance to the adsorption conveyance belt 21 is h1. As a result, the height of the topmost sheet gradually lowers and accordingly the overlap amount becomes L1, L2 and L3 in order, that is, the overlap amounts vary.

Therefore, in the present embodiment, to reduce the variability of overlap amounts depending on the degree of basis weight, for example, the pull-out sensor 43 detects the number of conveyed sheets, and, when the detected number reaches a predetermined value, adsorption of the next sheet is controlled to be delayed by constant time. That is, sheets are not continuously adsorbed to the adsorption conveyance belt, but, when the number of conveyed sheets detected by the pull-out sensor 43 in one job reaches a predetermined value, the sheet suction operation is controlled to stop for a certain period of time. After the elapse of the certain period of time, the suction shutter 37 is opened to start overlap feeding. By this means, it is possible to blow up a sheet to be adsorbed next, until the distance to the adsorption conveyance belt 21 becomes h1. Here, the job denotes a series of operations executed by the image forming apparatus so as to realize a sheet output form set by the user.

Figure 12:
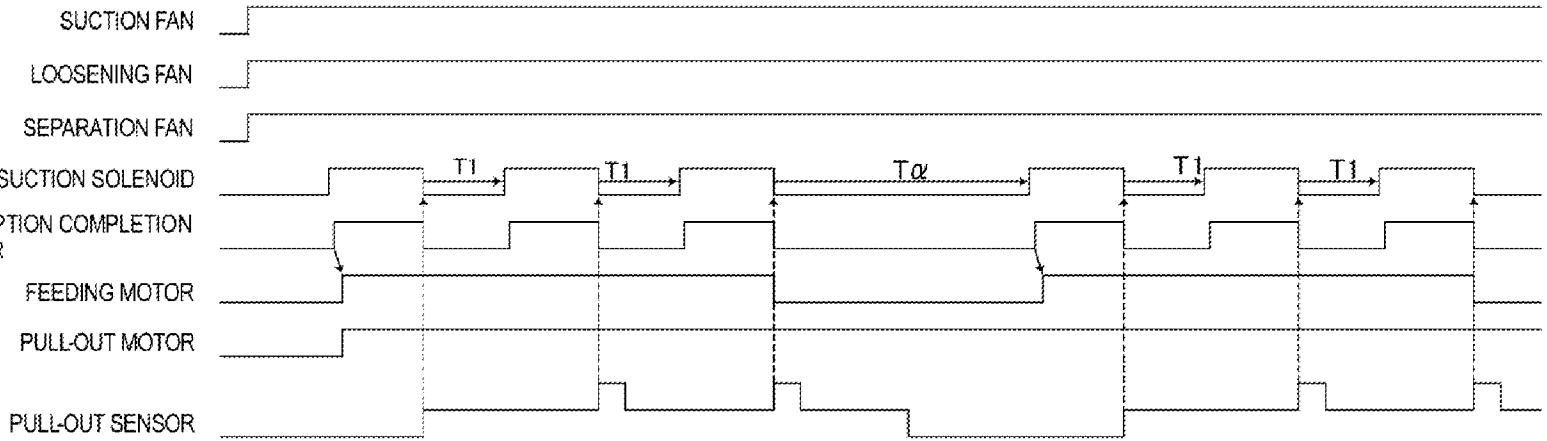
FIG. 12 is a timing chart to describe the above division-type overlap feeding control.

Also, in the present embodiment, as illustrated in FIG. 12 described later, the output intensity of the pull-out sensor 43 varies according to the thickness of passing sheets. Therefore, it is possible to detect an overlapping state by a change in the output intensity and detect the number of conveyed sheets by the change in the output intensity.

Figure 8B:
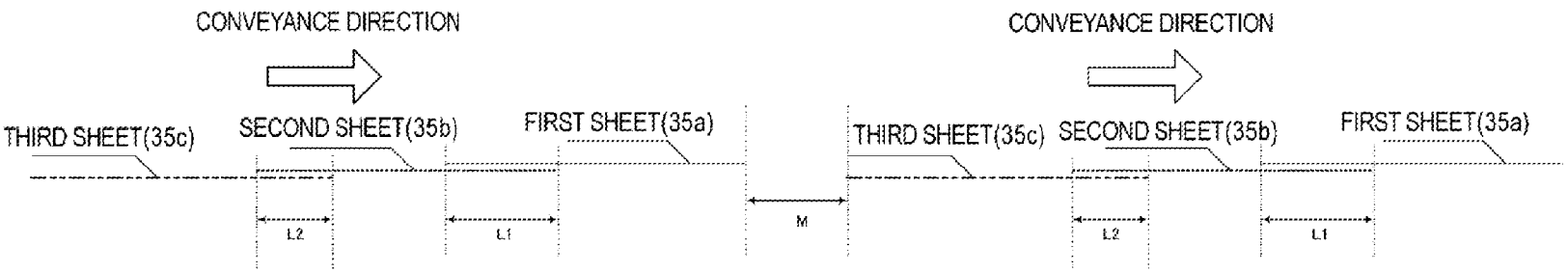

By performing control in this way, as illustrated in FIG. 8B, division-type overlap feeding with a sheet group of N (N=3) overlapped sheets as one set is realized. However, as illustrated in FIG. 8B, it is necessary to perform control such that the back end of a preceding sheet group and the front end of a subsequent sheet group are separated by predetermined distance interval M for a certain period of time. Here, as illustrated in FIG. 9A, this predetermined distance interval is determined in advance for each sheet basis weight, and the suction solenoid 38 is controlled such that it is set to the predetermined distance interval M.

For example, as illustrated in FIG. 9A, a value of the distance interval M is small in a case of ultra-thin paper of small basis weight since the time required to move the topmost sheet to a predetermined position is short, and a value of the distance interval M is large in a case of ultra-heavy paper of large basis weight since the time required to move the topmost sheet to a predetermined position is long. That is, as the sheet thickness becomes thicker, that is, as the sheet basis weight becomes larger, the distance interval M between the back end of a sheet group and the front end of a subsequent sheet group is set larger. Here, although the distance interval M between the back end of a sheet group and the front end of a subsequent sheet group is determined in advance for each sheet basis weight, it may be determined taking sheet materials into account.

Figure 10:
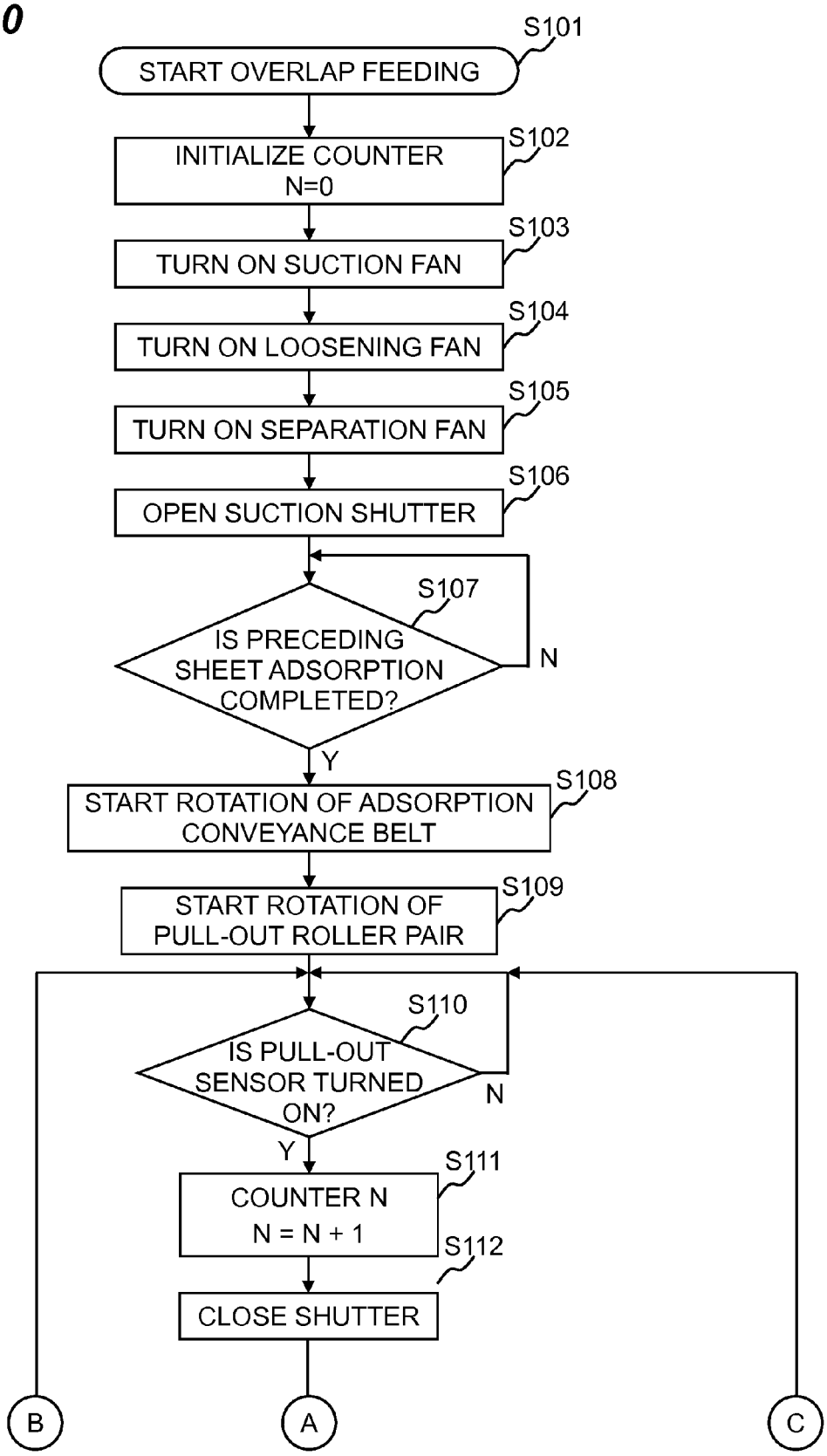
FIG. 10 is a first flowchart to describe division-type overlap feeding control by the above sheet feeding apparatus.
Figure 11:
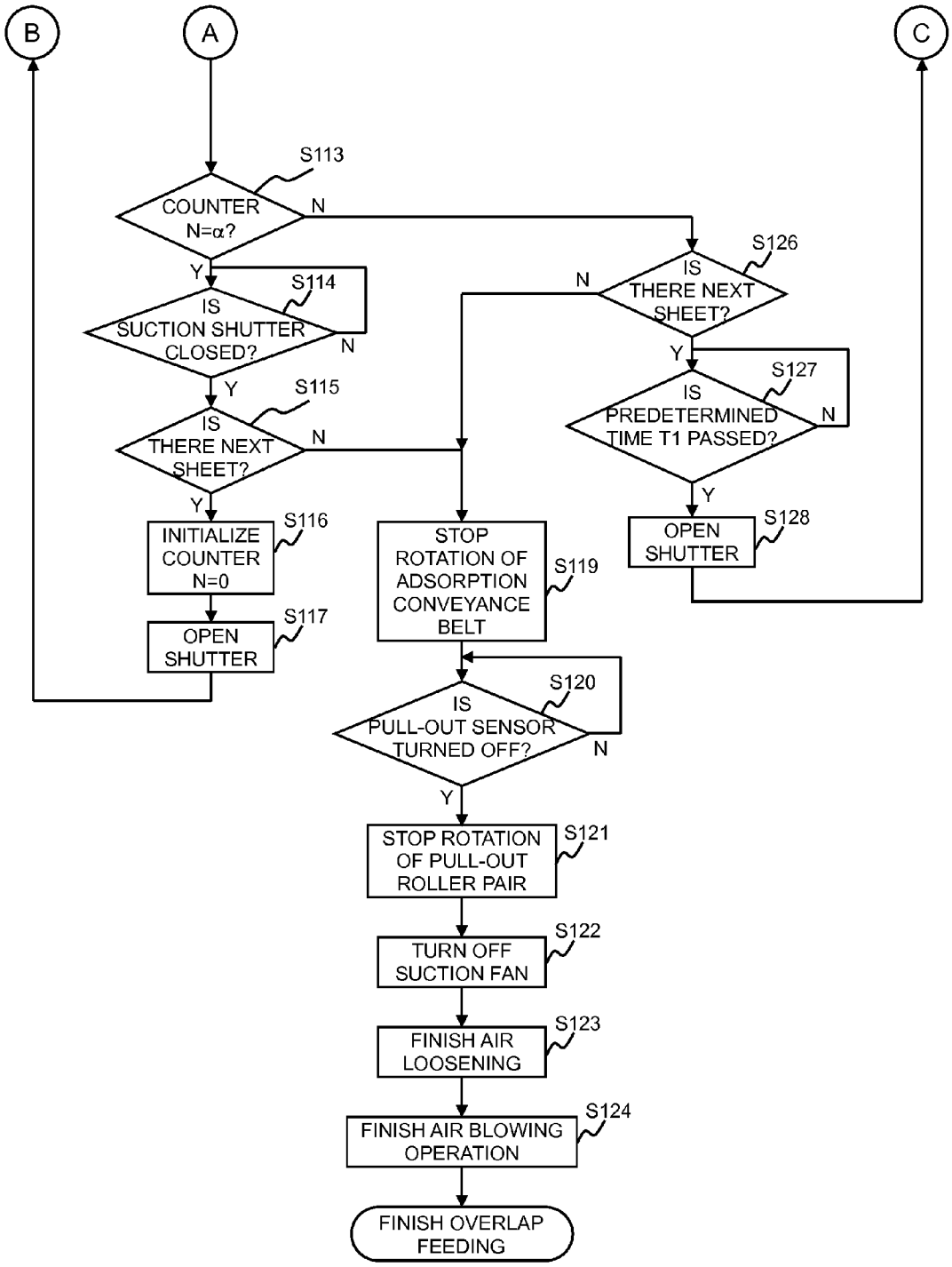
FIG. 11 is a second flowchart to describe the above division-type overlap feeding control.

Next, such division-type overlap feeding control according to the present embodiment will be described using the flowcharts illustrated in FIGS. 10 and 11 and the timing chart illustrated in FIG. 12. In a case of feeding a sheet, first, the user draws the sheet storage case 11 and sets the sheets 35. When the sheet storage case 11 is stored, the tray 12 lifts by the lift motor 19 as illustrated in FIG. 3A and stops at a position at which the distance between the adsorption conveyance belt 21 and the topmost sheet 35*a* is "B".

Next, when receiving a feeding signal, the CPU 1 initializes the counter N inside the CPU 1 (N=j) (S102). Next, a control signal is input in the suction fan driver 40 to turn on (or drive) the suction fan 36 (S103). Next, a control signal is input in the loosening fan driver 22A to turn on (or drive) the loosening fan 420 (S104) to blow air to the sheet front-end side and start loosening sheets. Also, a control signal is input in the separation fan driver 22B to turn on (or drive) the separation fan 430 (S105) and separate sheets by separation air. Here, the suction fan 36, the loosening fan 420 and the separation fan 430 may be activated at the same time or at different timings.

Next, a control signal is input in the suction shutter driver 39 to open the suction shutter 37 (S106). By this means, a preceding sheet separated by air from the separation fan 430 is adsorbed to the adsorption conveyance belt 21. When the preceding sheet is sucked to the adsorption conveyance belt 21 and the adsorption completion sensor 58 to detect an adsorption state of the preceding sheet is turned on, that is, when the preceding sheet has been adsorbed ("Y" in S107), rotation of the adsorption conveyance belt 21 is started (S108) to convey the preceding sheet. Also, rotation of the pull-out roller pair 42 is started at the same time as the rotation of the adsorption conveyance belt 21 (S109).

Here, although the rotation of the adsorption conveyance belt 21 and the activation of the pull-out roller pair 42 may be started at the same time or at different timings, when the front end of a conveyed sheet reaches the pull-out roller pair 42, the speed of the adsorption conveyance belt 21 and the speed of the pull-out roller pair 42 need to be equal. When the preceding sheet reaching the pull-out roller pair 42 is detected and the pull-out sensor 43 is turned on ("Y" in S110), the counter N inside the CPU 1 is updated (N=N+1) (S111). That is, the value of the counter N becomes "1" that is a value indicating that the first sheet is conveyed.

Next, when the front end of the preceding sheet is detected in the way, the suction shutter 37 is closed (S112). When the suction shutter 37 is closed, the negative pressure state in the suction duct is monitored and the adsorption completion sensor 58 to detect a completion of sheet adsorption is turned off. After that, it is determined whether a value of the counter N inside the CPU 1 is the predetermined value $\alpha$ (S113). This predetermined value $\alpha$ indicates the number of sheets that can be overlapped or the number of overlapped set sheets, and this predetermined value $\alpha$ may be a value determined in advance by basis weight or may be input by the user from a screen set in the operation portion 302. Here, in the present embodiment, $\alpha$ is set to "3".

Here, when the value of the counter N is not the predetermined value $\alpha$ ("N" in S113), the paper existence/non-existence detection sensor 56 determines whether there is the next sheet in the sheet storage case 11 (S126). When there is no next sheet in the sheet storage case 11 ("N" in S126), rotation of the adsorption conveyance belt 21 is stopped while closing the suction shutter 37 (S119). After that, when the back end of the preceding sheet passes and the pull-out sensor 43 is turned off ("Y" in S120), rotation of the pull-out roller is stopped (S121). Further, the suction fan is turned off (S122). Also, the loosening fan 420 is turned off to finish air loosening (S123) and the separation fan 430 is turned off to finish an air blowing operation (S124).

Meanwhile, when the value of the counter N is not the predetermined value α ("N" in S113) and there is the next sheet ("Y" in S126), the suction shutter 37 is opened (S128) after the elapse of the predetermined time T1 ("Y" in S127). By this means, a subsequent sheet is adsorbed to the adsorption conveyance belt such that the front end overlaps the back end of the preceding sheet by predetermined amount (L). Here, since the distance between the subsequent sheet and the adsorption conveyance belt 21 at this time is h2 as illustrated in FIG. 7B, the overlap amount between the back end of the preceding sheet and the front end of the subsequent sheet is actually L2 as illustrated in FIG. 8B.

After that, when the front end of a second sheet overlapping the preceding sheet passes through the pull-out sensor 43, as illustrated in FIG. 12, a signal level of the pull-out sensor 43 rises from a level at which one sheet is detected. When the signal level of the pull-out sensor 43 rises in this way, the CPU 1 updates the counter N ("Y" in S110 and S111). After that, as described above, the same processing is performed as in a case where "N" is "1".

After that, when the front end of a third sheet passes through the pull-out sensor 43, similar to the second sheet, the signal level of the pull-out sensor 43 rises from the level at which one sheet is detected, and the counter N is updated. That is, the value of the counter N becomes "3" that is a value indicating that the third sheet is conveyed. In this case, since the value of the counter N is the predetermined value α ("Y" in S113), after that, it is waited until predetermined time Tαα lapses to delay the timing at which a sheet is adsorbed to the adsorption conveyance belt 21 (S114).

Here, based on the basis weight of used sheets, this predetermined time Tα is set such that the back end of a preceding sheet group and the front end of a subsequent sheet group are set to have the distance interval M as illustrated in FIG. 9A. Here, Tα is greater than T1. By this means, it is possible to blow up a sheet to be adsorbed next, until the distance to the adsorption conveyance belt 21 becomes h1. Also, although the adsorption conveyance belt 21 is being operated at this time, it may be controlled to halt an operation of the adsorption conveyance belt 21 in S113 and operate it again after S117 described later.

Next, when the predetermined time Tα lapses ("Y" in S114), the paper existence/non-existence detection sensor 56 determines whether there is the next sheet in the sheet storage case 11 (S115). When there is no next sheet in the sheet storage case 11 ("N" in S115), processing in above S119 to S124 is performed. When the next sheet remains in the sheet storage case 11 ("Y" in S115), the counter N is initialized (N=0) to count sheets of the subsequent sheet bundle (S116).

Next, the suction shutter 37 is opened (S117) to restart adsorption of sheets of the subsequent sheet bundle. After that, when there is no next sheet in the sheet storage case 11 ("N" in S115), processing in above S119 to S124 is performed and a series of division-type overlap feeding operations is finished. Here, the lifter motor 19 may be controlled such that the topmost sheet moves to a desired position in S114.

Meanwhile, such overlapped sheet groups are separated one by one in the interflow conveying portion 319 illustrated in FIG. 1 and conveyed to the apparatus body 300. To be more specific, an overlap portion of the sheet groups reaches a position between the conveying roller 381 and the conveying roller 382, preceding sheet separation control is performed to make the conveyance speed of the conveying roller 381 faster than the conveyance speed of the conveying roller 382. Also, the acceleration of the conveying roller 381 and the conveyance speed after acceleration are decided taking the sheet overlap amount and the sheet size into account. Also, after the preceding sheet is separated from the subsequent sheet and the back end of the preceding sheet goes through the conveying roller 381 before the front end of the subsequent sheet reaches the conveying roller 381, it is controlled to return the speed of the conveying roller 381 to the speed of the conveying roller 382.

As described above, in the present embodiment, after a predetermined number of sheets is overlapped, when the next sheet is adsorbed, the switching timing of the suction shutter 37 is changed to the second timing later than the first timing that has been used. By this means, it is possible to create time required to return a topmost sheet position to a desired height, and therefore it is possible to absorb the variability of overlapped parts and perform a stable feeding operation. That is, when the number of sheets conveyed in an overlapping manner reaches a predetermined number, by delaying the switching timing of the suction shutter 37 and delaying adsorption of the next sheet, it is possible to reduce the variability of overlapped parts when feeding sheets in an overlapping manner.

Also, in the present embodiment, to reduce the variability of overlap amounts, the number of conveyed sheets is detected and, when the detected number reaches a predetermined value, the switching timing of the suction shutter 37 is controlled to be delayed, but the present invention is not limited to this. For example, according to the number of detections of sheet suction completion, the switching timing of the suction shutter 37 may be controlled to be delayed. That is, sheets are not continuously adsorbed to the adsorption conveyance belt, but, when the number of sheet suction completions detected by the adsorption completion sensor 58 in one job reaches a predetermined value, the sheet suction operation may be controlled to stop for a certain period of time.

Also, the distance from the front end to the back end of a preceding sheet bundle may be detected by the pull-out sensor 43 to change the timing to open the suction shutter 37 according to the detection result. For example, the distance ΔL from the front end to the back end of a preceding sheet bundle detected by the pull-out sensor 43 and a design value (or setting value) Ls are compared, and, when LS−ΔL>0, the suction shutter 37 is controlled to be opened at earlier timing. Also, when LS−ΔL<0, the suction shutter 37 is controlled to be opened at later timing, and, when LS=ΔL, the timing to open the suction shutter 37 is an initially set value.

Meanwhile, the above description has described a configuration to reduce the variability of overlap amounts by providing the distance interval M based on the basis weight of sheets used between a preceding sheet bundle and a subsequent sheet bundle. However, the sheet basis weight has a proportional relation to the sheet stiffness. That is, in a case of a sheet of small basis weight, the sheet stiffness is small. Therefore, in a case where end portions of sheets are absorbed and conveyed in an overlapping manner, when the overlap amount is set large, the front-end portion of the subsequent sheet is not directly adsorbed to the adsorption conveyance belt, and therefore it is concerned that the front-end portion droops. Also, regarding sheets of large basis weight, since the thickness of one sheet is around 200 to 300 μm, in a case where sheets are divided and fed in an overlapping manner, when the overlap amount per set is set too large, the overlap amounts vary as described above.

Therefore, according to the basis weight of sheets used, it is necessary to change the overlap amount and the number of overlapped sheets per set. Next, a second embodiment of the present invention will be described where the overlap amount and the number of overlapped sheets per set are changed according to the sheet basis weight used in this way.

Figure 13:
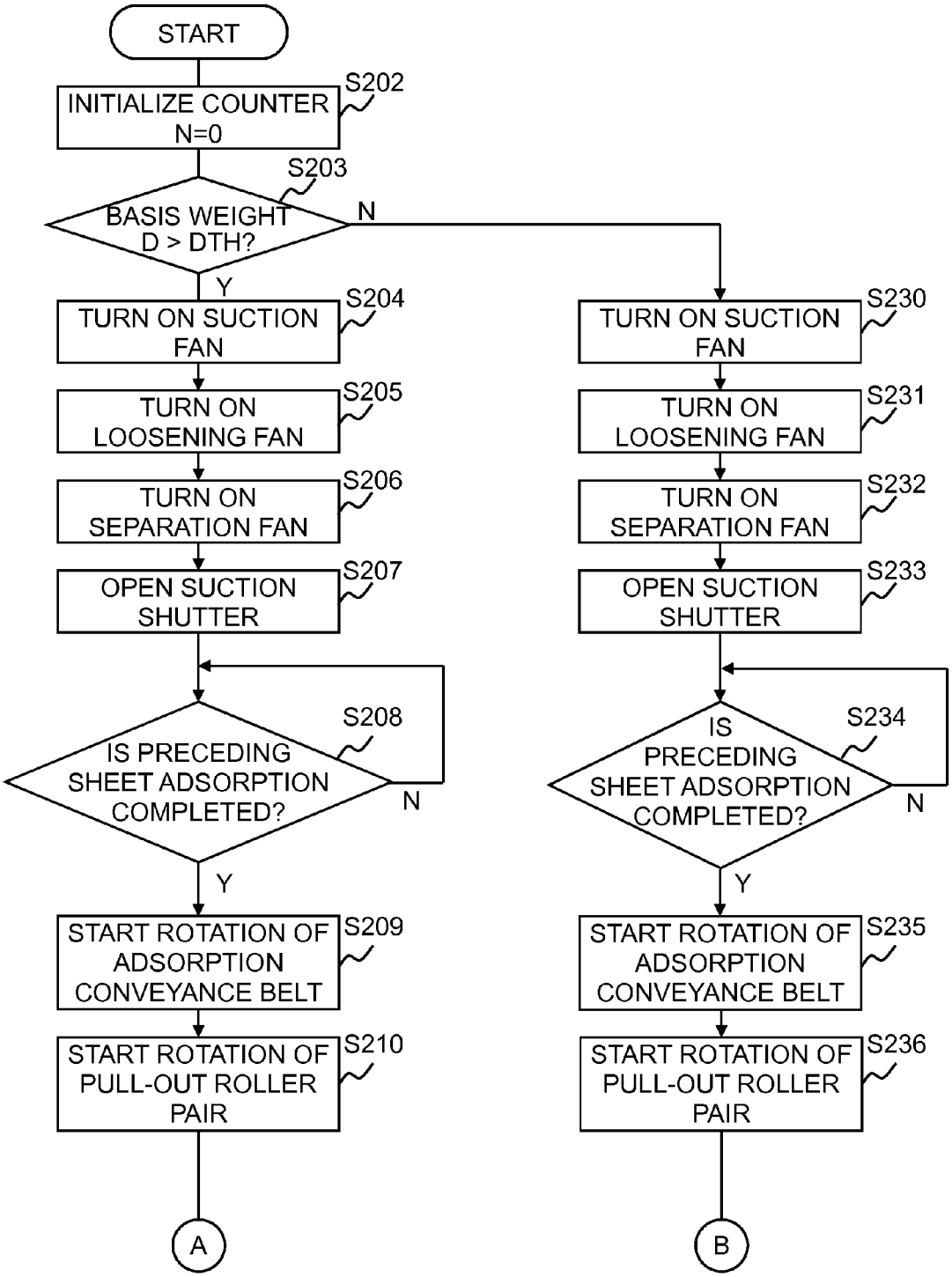
FIG. 13 is a first flowchart to describe division-type overlap feeding control in a sheet feeding apparatus according to a second embodiment of the present invention.
Figure 14:
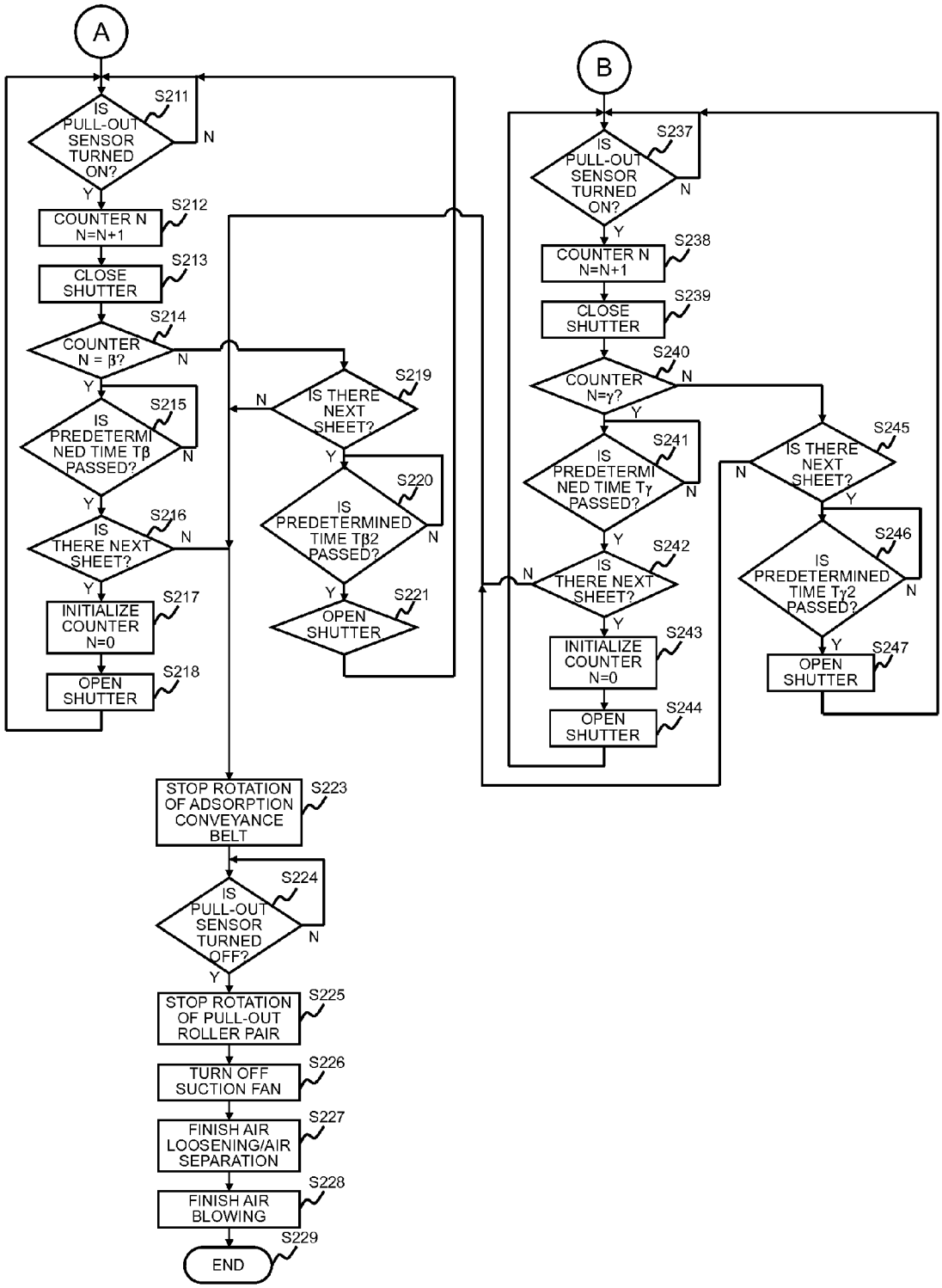
FIG. 14 is a second flowchart to describe the above division-type overlap feeding control.

FIGS. 13 and 14 are flowcharts to describe division-type overlap feeding control in a sheet feeding apparatus according to the present embodiment. When receiving a feeding signal, first, the CPU 1 initializes the counter N inside the CPU 1 (N=0) (S202). Next, the basis weight of a sheet used is determined (S203). Here, the setting of information related to sheet basis weight may be performed in advance from the operation portion 302. When the basis weight D of the sheet used is greater than preset threshold basis weight DTH ("Y" in S203), a control signal is input in the suction fan driver 40 to turn on (or drive) the suction fan 36 (S204). Next, a control signal is input in the loosening fan driver 22A to turn on (or drive) the loosening fan 420 (S205), blow air to the sheet front-end side and start loosening sheets. Also, a control signal is input in the separation fan driver 22B to turn on (or drive) the separation fan 430 (S206) and start to separate sheets by separation air. Here, the suction fan 36, the loosening fan 420 and the separation fan 430 may be activated at the same time or at different timings.

Next, a control signal is input in the suction shutter driver 39 to open the suction shutter 37 (S207). By this means, a preceding sheet separated by air from the separation fan 430 is adsorbed to the adsorption conveyance belt 21. When the preceding sheet is sucked to the adsorption conveyance belt 21 and the adsorption completion sensor 58 to detect an adsorption state of the preceding sheet is turned on, that is, when the preceding sheet has been adsorbed ("Y" in S208), rotation of the adsorption conveyance belt 21 is started (S209) to convey the preceding sheet. Also, rotation of the pull-out roller pair 42 is started at the same time as the rotation of the adsorption conveyance belt 21 (S210).

When the preceding sheet reaching the pull-out roller pair 42 is detected and the pull-out sensor 43 is turned on ("Y" in S211), the counter N inside the CPU 1 is updated (N=N+1) (S212). That is, the value of the counter N becomes "1" that is a value indicating that the first sheet is conveyed. Next, when the front end of the preceding sheet is detected in the way, the suction shutter 37 is closed (S213). When the suction shutter 37 is closed, the adsorption completion sensor 58 is turned off.

After that, it is determined whether a value of the counter N inside the CPU 1 is the predetermined value β (S214). This predetermined value β indicates the number of sheets that can be overlapped or the number of overlapped set sheets, and this predetermined value β may be a value determined in advance by basis weight. Here, when the value of the counter N is not the predetermined value β ("N" in S214), it is determined whether there is the next sheet in the sheet storage case 11 (S219). When there is no next sheet in the sheet storage case 11 ("N" in S219), rotation of the adsorption conveyance belt 21 is stopped while closing the suction shutter 37 (S223). After that, when the pull-out sensor 43 is turned off ("Y" in S224), rotation of the pull-out roller pair 42 is stopped (S225) and, furthermore, the suction fan is turned off (S226). Also, the loosening fan 420 and the separation fan 430 are turned off to finish the air loosening/air separation operation (S227) and finish an air blowing operation (S228).

Meanwhile, when the value of the counter N is not the predetermined value β ("N" in S214) and there is the next sheet ("Y" in S219), the suction shutter 37 is opened (S221) after the elapse of the predetermined time Tβ2 ("Y" in S220). By this means, a subsequent sheet is adsorbed to the adsorption conveyance belt such that the back end of the preceding sheet and the front end of the subsequent sheet overlap by predetermined amount (L).

Here, the overlap amount (L) between the back end of the preceding sheet and the front end of the subsequent sheet is decided based on consideration data such that it is set to an optimal value not to cause feeding error due to the sheet thickness or stiffness. For example, as illustrated in FIG. 9B, the overlap amount (L) is 10 mm in a case of an ultra-thin paper, and the overlap amount (L) is 50 mm in a case of ultra-heavy papers. This is because, in the case of ultra-thin papers, when the overlap amount (L) increases, the front end of a subsequent sheet droops, which may cause feeding error. Also, in the case of ultra-heavy papers, since there is a sheet drape, even if the overlap amount (L) is increased, the front end of a subsequent sheet does not droop, which is less likely to cause feeding error.

Meanwhile, when the value of the counter N is the predetermined value β ("Y" in S214), it is waited that the predetermined time Tβ lapses (S215), and, when the predetermined time Tβ lapses ("Y" in S215), it is determined whether there is the next sheet in the sheet storage case 11 (S216). Here, the suction shutter 37 is controlled such that, based on the basis weight of used sheets, this Tβ is the interval between the back end of a preceding sheet group and the front end of a subsequent sheet group as illustrated in FIG. 9A. Here, Tβ is greater than Tβ2.

When there is no next sheet ("N" in S216), processing in above S223 to S228 is performed. Also, when there is the next sheet ("Y" in S216), the counter N to count sheets of the subsequent sheet bundle is initialized (N=0) (S217). Next, the suction shutter 37 is opened (S218) to restart adsorption of sheets. After that, when there is no next sheet in the sheet storage case 11 ("N" in S216), processing in above S223 to S228 is performed and a series of division-type overlap feeding operations is finished.

Meanwhile, when the sheet basis weight D is equal to or less than the preset threshold basis weight DTH ("N" in S203), the suction fan 36 is driven (S230), and, after that, the loosening fan 420 is turned on (or driven) (S231) to blow air to the sheet front-end side and start loosening sheets. Also, the separation fan 430 is turned on (or driven) (S232) to separate sheets by separation air.

Next, the suction shutter 37 is opened (S233). By this means, a preceding sheet separated by air from the separation fan 430 is adsorbed to the adsorption conveyance belt 21. When the preceding sheet is sucked to the adsorption conveyance belt 21 and the adsorption completion sensor 58 is turned on, that is, when the preceding sheet has been adsorbed ("Y" in S234), rotation of the adsorption conveyance belt 21 is started (S235) to convey the preceding sheet. Also, rotation of the pull-out roller pair 42 is started at the same time as the rotation of the adsorption conveyance belt 21 (S236).

When the preceding sheet reaching the pull-out roller pair 42 is detected and the pull-out sensor 43 is turned on ("Y" in S237), the counter N inside the CPU 1 is updated (N=N+1) (S238). After that, the suction shutter 37 is closed (S239). When the suction shutter 37 is closed, the adsorption completion sensor 58 is turned off. Next, it is determined whether a value of the counter N inside the CPU 1 is the predetermined value γ (S240).

This predetermined value γ indicates the number of sheets that can be overlapped or the number of overlapped set sheets, and this predetermined value γ may be a value determined in advance by basis weight. That is, this predetermined value γ differs from the predetermined value β in the case where the sheet basis weight D is greater than the preset threshold basis weight DTH. Here, this predetermined value γ may be a value determined in advance by basis weight or may be input by the user from the operation portion 302.

Here, when the value of the counter N is not the predetermined value γ ("N" in S240), it is determined whether there is the next sheet in the sheet storage case 11 (S245). When there is the next sheet in the sheet storage case 11 ("Y" in S245), after the elapse of a predetermined period of time Tγ2 ("Y" in S246), the suction shutter 37 is opened (S247). By this means, the next sheet is adsorbed to the adsorption conveyance belt such that the front end of the next sheet and the back end of the preceding sheet overlap by the predetermined amount (L). Also, when there is no next sheet ("N" in S245), rotation of the adsorption conveyance belt 21 is stopped while closing the suction shutter 37 (S223). After that, processing in above S224 to S228 is performed and an air blowing operation is finished.

Meanwhile, after that, when a sheet is fed and the value of the counter N becomes the predetermined value γ ("Y" in S240), it is waited that the predetermined time Tγ lapses (S241), and, when the predetermined time Tγ lapses ("Y" in S241), it is determined whether there is the next sheet in the sheet storage case 11 (S242). Here, the suction shutter 37 is controlled such that, based on the basis weight of used sheets, this Tγ is the interval between the back end of a preceding sheet group and the front end of a subsequent sheet group as illustrated in FIG. 9A. Here, Tγ is greater than Tγ2. Also, although the adsorption conveyance belt 21 is being operated at this time, it may be controlled to stop an operation of the adsorption conveyance belt 21 in S242 and operate it again after S244.

Next, when there is no next sheet ("N" in S242), the processing in above S223 to S228 is performed. Also, when there is the next sheet ("Y" in S242), the counter N is initialized (N=0) (S243). Next, the suction shutter 37 is opened (S244) to restart sheet adsorption.

Next, according to the magnitude of sheet basis weight, description will be given regarding overlap number (β, γ), predetermined time (Tβ2, Tγ2) to decide the overlap amount and predetermined time (Tβ, Tγ) to decide the distance between the back end of a preceding sheet bundle and the front end of a subsequent sheet bundle. As described above, when the sheet basis weight is large, the overlap amount is likely to vary as the overlap number increases. Therefore, the overlap number is set so as to establish $\beta<\gamma$. Also, regarding the overlap amount, since the overlap amount can be larger when the sheet basis weight is larger, the time to decide the overlap amount is set so as to establish $T\beta 2>T\gamma 2$.

Regarding the interval (or distance) between the back end of a preceding sheet bundle and the front end of a subsequent sheet bundle, since time required for the topmost sheet to reach a desired position is longer when the sheet basis weight becomes larger, the interval is set so as to establish $T\beta>T\gamma$. Also, although the present embodiment has described a control flowchart in which it is determined whether the sheet basis weight D is D>DTH or D≦DTH, several items of DTH may be set for the sheet basis weight or materials.

As described above, in the present embodiment, the timing to switch the suction shutter 37 to an adsorption position is delayed such that the sheet overlap amount decreases when the sheet basis weight becomes smaller. Also, it is set such that, when the sheet basis weight becomes larger, the overlap number decreases and a predetermined interval between the back end of a preceding sheet bundle and the front end of a subsequent sheet bundle is widened. By this means, when feeding sheets in an overlapping manner, it is possible to reduce the variability of overlapped parts.

Figure 15A:
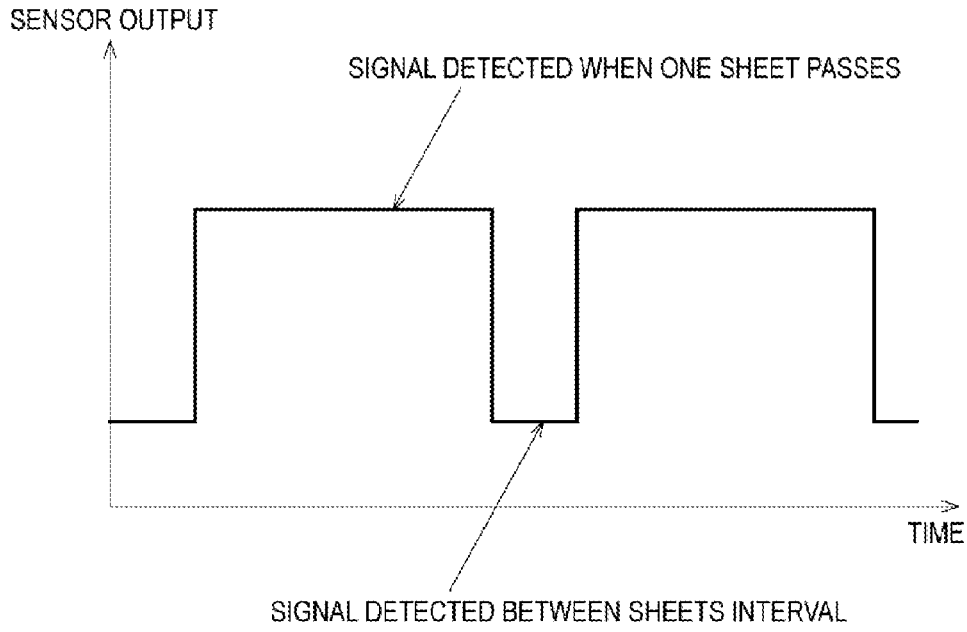
FIGS. 15A and 15B are diagrams illustrating signal waveforms detected by a pull-out sensor at the time of division-type overlap feeding.
Figure 15B:
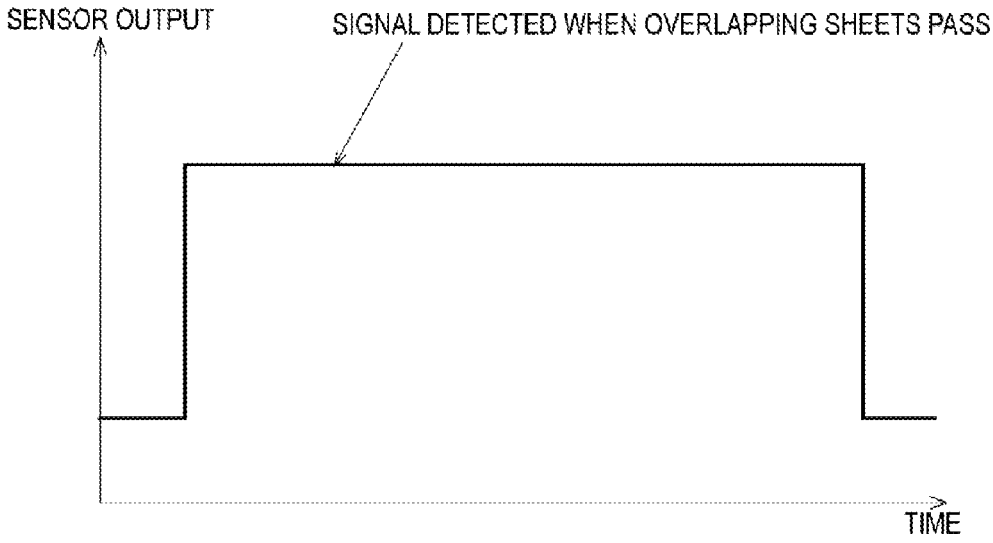

Next, a third embodiment of the present invention will be described. FIGS. 15A and 15B are diagrams illustrating signal waveforms of the pull-out sensor 43 at the time of division-type overlap feeding, and FIG. 15A illustrates a signal waveform in a case where sheets are fed one by one. Here, when sheets are fed one by one, it is possible to detect a sheet interval based on a signal from the pull-out sensor 43. By contrast with this, in a case of the division-type overlap feeding with N overlapped sheets as one set, since there is no sheet interval, a signal detected by the pull-out sensor 43 is as illustrated in FIG. 15B. That is, in the case of the division-type overlap feeding, the signal waveform of the pull-out sensor 43 is equivalent to detection of one sheet having a very long length in the conveyance direction.

The overlap amount at the time of overlapping the preceding sheet and the subsequent sheet is determined by the adsorption timing of adsorbing the sheets to the adsorption conveyance belt. Also, it is decided based on the sheet basis weight or size how many sheets are overlapped and used as one set. Therefore, from used sheet information, the CPU 1 can estimate how a signal waveform detected by the pull-out sensor 43 is formed. Therefore, when a signal waveform at the time the pull-out sensor 43 detects that a sheet passes, is largely different from the estimation in the CPU 1, it is possible to determine that feeding error, that is, a jam is caused.

Figure 16:
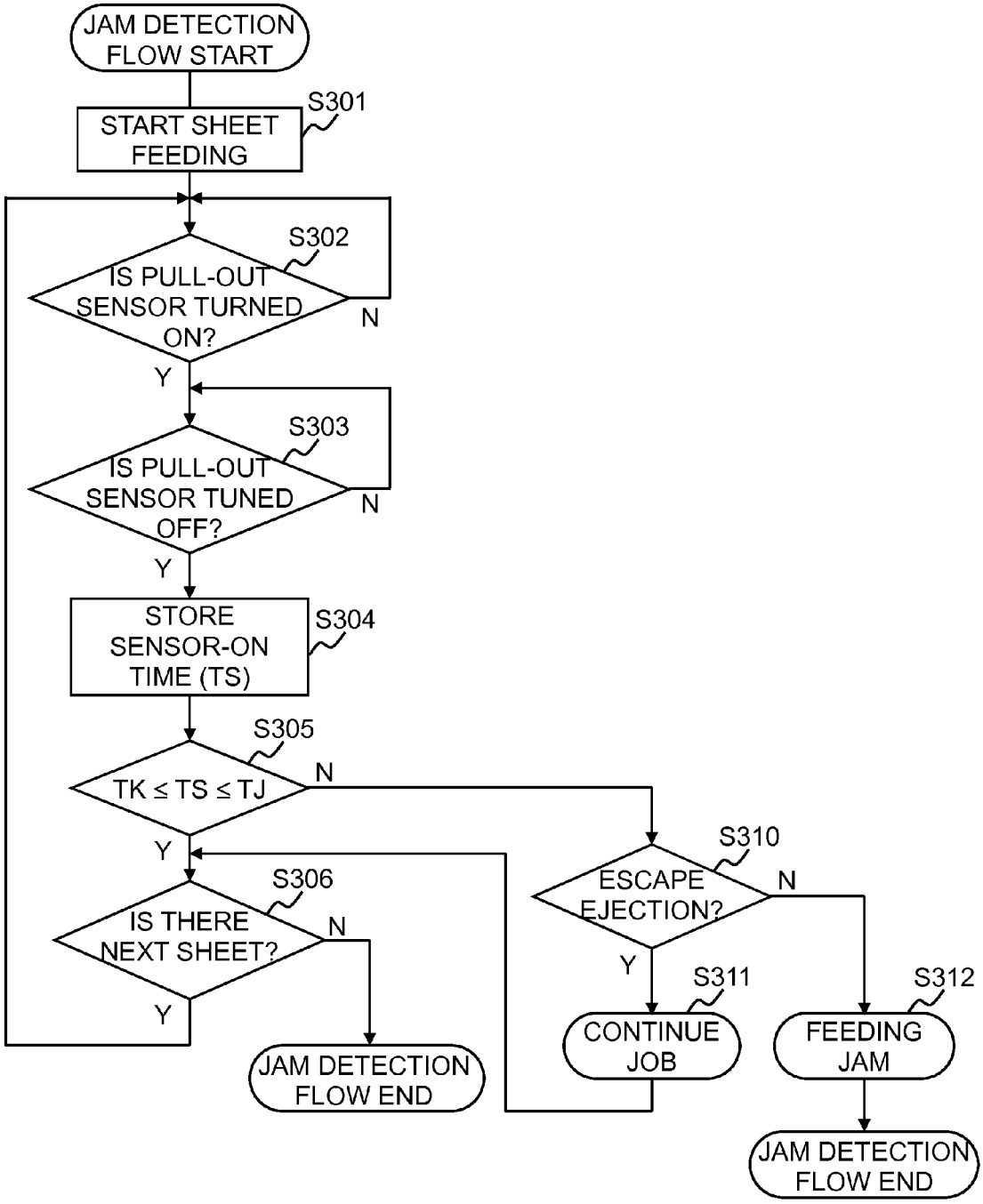
FIG. 16 is a flowchart to describe division-type overlap feeding in a sheet feeding apparatus according to a third embodiment of the present invention.

Therefore, in the present embodiment, a sheet jam is detected based on a signal waveform detected by the pull-out sensor 43. Next, sheet jam detection according to the present embodiment will be described using the flowchart illustrated in FIG. 16.

In a case of feeding a sheet, first, the user draws the sheet storage case 11 and sets the sheets 35. When the sheet storage case 11 is stored, the tray 12 lifts by the lift motor 19 as illustrated in FIG. 3A and stops at a position at which the distance between the adsorption conveyance belt 21 and the topmost sheet 35*a* is "B".

Next, when receiving a feeding signal, the CPU 1 starts a jam detection flow at the same time. The CPU 1 starts sheet feeding based on the feeding signal (S301) and determines whether the sheet front end reaches the pull-out sensor 43. When the sheet front end reaches the pull-out sensor 43 and the pull-out sensor 43 is tuned on ("Y" in S302), a timer (not illustrated) is operated to measure sheet transit time. Next, when the back end of the fed sheet passes and the pull-out sensor 43 is turned off ("Y" in S303), the detected sensor ON time (TS) is stored in the storage unit 3 (S304).

Here, it is assumed that the detection time of the pull-out sensor 43 in a case of the division-type overlap feeding is "TS" and the acceptable upper limit value as a prescribed value of the ON time of the pull-out sensor 43 is "TJ" and the acceptable lower limit value is "TK." Here, these time TJ and time TK as a determination criterion are decided for each sheet size or basis weight, taking the variability of adsorption time when sheets are adsorbed to the adsorption conveyance belt into account. As a specific example, a decision method will be illustrated in the case of division-type overlap conveyance of A4-size ultra-heavy papers. As conditions, it is assumed that the basis weight is 300 g/m$^2$ (ultra-heavy papers), and the conveyance speed is 360 mm/sec. Further, it is assumed that the sheet overlap number per set is five and the overlap amount is 20 mm.

In this case, when five sheets are overlapped as one set, the length from the front end of the first sheet to the back-end portion of the fifth sheet is calculated as 970 mm (=210+(210−20)×4). Also, among these five sheets, when two sheets are completely overlapped (complete overlap feeding), this unit length is calculated as 780 mm (=210+(210−20)×3).

In a case of normal conveyance, since the sheets are conveyed at conveyance speed of 360 mm/sec, the transit time (i.e. the ON time of the pull-out sensor 43) after the pull-out sensor 43 detects the front end of the first sheet before detecting the back end of the fifth sheet, is calculated as 2.7 sec (≈970/360 sec). By contrast with this, among the five sheets, when two sheets are completely overlapped, the time detected by the pull-out sensor 43 is calculated as 2.2 sec (≈780/360). As a result of this, even if the variability of adsorption time at the time of adsorbing sheets to the adsorption conveyance belt 21 is taken into account, by setting TJ to 2.4 sec, it is possible to decide a feeding jam.

Also, when all the overlap amounts are actually 5 mm, the length from the front end of the first sheet to the back-end portion of the fifth sheet is calculated as 1010 mm (=210+(210−5)×4). In this case, the time detected by the pull-out sensor 43 is calculated as 2.86 sec (≈1030/360). Therefore, by setting TK to 2.75 sec, it is possible to decide a feeding jam.

By setting the threshold time TJ and TK as in the above example, it is possible to determine sheet feeding error. That is, when the detection time (or transit time) TS is within a predetermined time range (TK≦TS≦TJ) ("Y" in S305), it is determined that the sheet is normally conveyed, and, after that, it is detected whether there is a next sheet (S306). If there is a next sheet ("Y" in S306), processing in S302 to S306 is repeated. If there is no next sheet ("N" in S306), the jam detection flow is finished.

Meanwhile, when the detection time TS is not within the predetermined time range (TK≦TS≦TJ) ("N" in S305), it is determined whether to perform an escape ejection (S310). Here, in FIG. 1, the escape ejection denotes a function of performing control such that a target sheet or sheet bundle passes through the escape path 390 and is ejected onto the escape tray 101 to continue a job without stopping a machine operation.

When the escape ejection is selected ("Y" in S310), the target sheet bundle is controlled to be escape-ejected and the job continues (S311). Here, for example, in S305, in a case of TS<TK, that is, when the transit time exceeds the predetermined time range, it is possible to determine an abnormal state due to a sheet complete overlap feeding jam or a large sheet overlap amount. Therefore, in this case, after the target sheet group is escape-ejected in S310, the job continues. Here, when the escape ejection is not selected ("N" in S310), jam recovery is performed to stop all of the adsorption conveyance belt 21, the suction shutter 37, the pull-out roller pair 42, the suction fan 36, the loosening fan 420 and the separation fan 430 (S312).

Also, in the present embodiment, in a case of TS>TJ in S305, that is, when the transit time does not reach the predetermined time range, an abnormal state of productivity decline due to a small sheet overlap amount is determined. In this case, by displaying the productivity reduction, it is not processed as an abnormal state.

Thus, in the present embodiment, by detecting the transit time of a predetermined number of sheets conveyed in an overlapping manner, when sheets are fed in an overlapping manner, it is possible to reduce the variability of overlapped parts and detect an occurrence of a jam. When the detected transit time exceeds a prescribed value, by performing escape ejection or jam recovery, it is possible to prevent the productivity decline.

Also, in the present embodiment, when there is a next sheet in S306, it may be possible to perform control such that the adsorption timing of the next sheet is delayed by only TK−TS. As a result, after that, it is possible to stay the detection time TS within the predetermined time range, eliminate the escape ejection and prevent the productivity decline. Also, after a target sheet group is escape-ejected in S310, when the job continues (S311) and there is a next sheet in S306, by performing control such that the adsorption timing of the next sheet is accelerated by TS−TJ, the productivity may be maintained.

Further, the first timing to switch the suction shutter 37 to an adsorption position may be accelerated when the transit time exceeds the predetermined time range, and the first timing may be delayed when the transit time does not exceed the predetermined time range.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-165267, filed Jul. 28, 2011, which is hereby incorporated by reference herein in its entirety.

What is claimed is:

1. A sheet feeding apparatus comprising a tray that can lift and lower and that holds a sheet, an air blowing portion that blows up a sheet by blowing an air to a side end of the sheet held by the tray and an adsorption conveyance system that adsorbs and conveys the blown up sheet, wherein the adsorption conveyance system comprises:

an adsorption conveying portion that adsorbs and conveys the sheet blown up by blowing the air;

a negative pressure generation portion that generates a negative pressure to adsorb the sheet to the adsorption conveying portion;

an adsorption switching portion that is switchable between an adsorption position to adsorb a sheet by the negative pressure generated by the negative pressure generation portion and a block position to block the negative pressure; and a controller that controls the adsorption switching portion from the block position to the adsorption position such that a preceding sheet adsorbed in advance to the adsorption conveying portion is conveyed while partially overlapping a subsequent sheet, and in a case where a number of sheets conveyed in an overlapping manner reaches a predetermined sheet number and a next sheet is adsorbed, the controller changes a timing of switching the adsorption switching portion to the adsorption portion, from a first timing at which the subsequent sheet overlaps the preceding sheet to a second timing later than the first timing, and returns the timing to the first timing after the next sheet is adsorbed.

2. The sheet feeding apparatus according to claim 1, further comprising a setting portion that sets a sheet basis weight, wherein, based on setting information in the setting portion, the controller slows the second timing as the sheet basis weight increases.

3. The sheet feeding apparatus according to claim 2, wherein, based on the setting information in the setting portion, the controller slows the first timing so as to reduce an overlapping amount between the preceding sheet and the subsequent sheet as the sheet basis weight decreases.

4. The sheet feeding apparatus according to claim 2, wherein, based on the setting information in the setting portion, the controller decreases the predetermined sheet number as the sheet basis weight increases.

5. The sheet feeding apparatus according to claim 1, further comprising a detecting portion that detects a sheet conveyed by the adsorption conveying portion, wherein, based on the detection in the detecting portion, the controller detects a transit time of the predetermined number of sheets conveyed in an overlapping manner, advances the first timing in a case where the transit time exceeds a predetermined time range, and delays the first timing in a case where the transit time does not reach the predetermined time range.

6. The sheet feeding apparatus according to claim 1, further comprising a paper plane detecting portion that detects a paper plane position of a topmost sheet held by the tray, wherein, in a case where the adsorption switching portion is switched to the adsorption portion at the second timing, the tray is raised such that the paper plane of the topmost sheet is detected by the paper plane detecting portion.

7. An image forming apparatus comprising a tray that can lift and lower and that holds a sheet, an air blowing portion that blows up a sheet by blowing an air to a side end of the sheet held by the tray, an adsorption conveyance system that adsorbs and conveys the blown sheet and an image forming portion that forms an image on a sheet adsorbed and fed by the adsorption conveyance system, wherein the adsorption conveyance system comprises:

an adsorption conveying portion that adsorbs and conveys the sheet blown up by blowing the air;

a negative pressure generation portion that generates a negative pressure to adsorb the sheet to the adsorption conveying portion;

an adsorption switching portion that is switchable between an adsorption position to adsorb a sheet by the negative pressure generated by the negative pressure generation portion and a block position to block the negative pressure; and a controller that controls the adsorption switching portion from the block position to the adsorption position such that a preceding sheet adsorbed in advance to the adsorption conveying portion is conveyed while partially overlapping a subsequent sheet, and in a case where a number of sheets conveyed in an overlapping manner reaches a predetermined sheet number and a next sheet is adsorbed, the controller changes a timing of switching the adsorption switching portion to the adsorption portion, from a first timing at which the subsequent sheet overlaps the preceding sheet to a second timing later than the first timing, and returns the timing to the first timing after the next sheet is adsorbed.

8. The image forming apparatus according to claim 7, further comprising a setting portion that sets a sheet basis weight, wherein, based on setting information in the setting portion, the controller slows the second timing as the sheet basis weight increases.

9. The image forming apparatus according to claim 8, wherein, based on the setting information in the setting portion, the controller slows the first timing so as to reduce an overlapping amount between the preceding sheet and the subsequent sheet as the sheet basis weight decreases.

10. The image forming apparatus according to claim 8, wherein, based on the setting information in the setting portion, the controller decreases the predetermined sheet number as the sheet basis weight increases.

11. The image forming apparatus according to claim 7, further comprising a detecting portion that detects a sheet conveyed by the adsorption conveying portion, wherein, based on the detection in the detecting portion, the controller detects a transit time of the predetermined number of sheets conveyed in an overlapping manner, advances the first timing in a case where the transit time exceeds a predetermined time range, and delays the first timing in a case where the transit time does not reach the predetermined time range.

12. The image forming apparatus according to claim 7, further comprising a paper plane detecting portion that detects a paper plane position of a topmost sheet held by the tray, wherein, in a case where the adsorption switching portion is switched to the adsorption portion at the second timing, the tray is raised such that the paper plane of the topmost sheet is detected by the paper plane detecting portion.

13. The image forming apparatus according to claim 7, comprising:

a detecting portion that detects a sheet conveyed by the adsorption conveying portion;

a first conveyance path guiding a sheet to the image forming portion; and a second conveyance path guiding a sheet from a near side of the image forming portion to an ejection portion, wherein a transit time of the predetermined number of sheets conveyed in an overlapping manner is detected based on the detection in the detecting portion, and, in a case where the transit time is within a predetermined time range, the predetermined number of sheets is conveyed to the first conveyance path, and, in a case where the transit time exceeds the predetermined time range, the predetermined number of sheets is conveyed to the second conveyance path.

* * * * *